US010174957B2

(12) United States Patent
Burns et al.

(10) Patent No.: US 10,174,957 B2
(45) Date of Patent: Jan. 8, 2019

(54) SYSTEM AND METHOD FOR CONTROLLING MULTI-ZONE VAPOR COMPRESSION SYSTEMS

(71) Applicant: Mitsubishi Electric Research Laboratories, Inc., Cambridge, MA (US)

(72) Inventors: Daniel J. Burns, Wakefield, MA (US); Stefano Di Cairano, Somerville, MA (US); Scott A. Bortoff, Brookline, MA (US); Christopher R. Laughman, Waltham, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 524 days.

(21) Appl. No.: 14/809,545

(22) Filed: Jul. 27, 2015

(65) Prior Publication Data

US 2017/0030598 A1 Feb. 2, 2017

(51) Int. Cl.
*F25B 5/00* (2006.01)
*F24F 3/06* (2006.01)
(Continued)

(52) U.S. Cl.
CPC ..... *F24F 3/065* (2013.01); *F24F 11/30* (2018.01); *F24F 11/62* (2018.01); *F24F 11/83* (2018.01); *F25B 5/02* (2013.01); *F25B 6/02* (2013.01); *F25B 13/00* (2013.01); *F25B 49/02* (2013.01); *F25B 49/027* (2013.01); *F24F 11/46* (2018.01);
(Continued)

(58) Field of Classification Search
CPC .. F24F 3/065; F24F 11/62; F24F 11/83; F24F 11/30; F24F 11/84; F24F 11/63; F24F 11/54; F24F 11/46; F24F 2110/00; F24F 2001/0074; F24F 2140/50; F25B 49/027;
(Continued)

(56) References Cited

U.S. PATENT DOCUMENTS 5,007,245 A 4/1991 Defenbaugh et al.
7,331,191 B2 2/2008 He et al.
(Continued)

FOREIGN PATENT DOCUMENTS

EP 2469201 A2 6/2012

*Primary Examiner* — Ljiljana Ciric
(74) *Attorney, Agent, or Firm* — Gennadiy Vinokur; James McAleenan; Hironori Tsukamoto

(57) ABSTRACT

A multi-zone vapor compression system (MZ-VCS) includes a compressor connected to a set of heat exchangers controlling environments in a set of zones. A supervisory controller includes a processor configured for optimizing a cost function subject to constraints on an operation of the MZ-VCS to produce a set of values of the thermal capacity requested for the set of heat exchangers to achieve setpoint temperatures in the corresponding zones. The supervisory controller is a model predictive controller for determining the set of control inputs using a model of the MZ-VCS including a linear relationship between the thermal capacity of each heat exchanger and the temperature in a corresponding zone controlled by the heat exchanger. A set of capacity controllers, wherein there is one capacity controller for each heat exchanger, such that each capacity controller is configured for controlling the corresponding heat exchanger to achieve the requested thermal capacity.

18 Claims, 21 Drawing Sheets

(51) Int. Cl.

| | |
|---|---|
| ***F25B 5/02*** | (2006.01) |
| ***F25B 6/02*** | (2006.01) |
| ***F25B 13/00*** | (2006.01) |
| ***F25B 49/02*** | (2006.01) |
| ***F24F 11/30*** | (2018.01) |
| ***F24F 11/62*** | (2018.01) |
| ***F24F 11/83*** | (2018.01) |
| *F24F 1/00* | (2011.01) |
| *F24F 110/00* | (2018.01) |
| *F24F 140/50* | (2018.01) |
| *F24F 140/60* | (2018.01) |
| *F24F 11/63* | (2018.01) |
| *F24F 11/54* | (2018.01) |
| *F24F 11/46* | (2018.01) |
| *F24F 11/84* | (2018.01) |

(52) U.S. Cl.
CPC ..... *F24F 11/54* (2018.01); *F24F 11/63* (2018.01); *F24F 11/84* (2018.01); *F24F 2001/0074* (2013.01); *F24F 2110/00* (2018.01); *F24F 2140/50* (2018.01); *F24F 2140/60* (2018.01); *F25B 2313/0233* (2013.01)

(58) Field of Classification Search
CPC .. F25B 6/02; F25B 49/02; F25B 13/00; F25B 5/02; F25B 2313/0233
See application file for complete search history.

(56) References Cited

U.S. PATENT DOCUMENTS 8,630,741 B1 * 1/2014 Matsuoka ..... H04L 12/2829 700/276
9,810,442 B2 * 11/2017 Matsuoka ..... G05D 23/1904
10,030,880 B2 * 7/2018 Matsuoka ..... H04L 12/2829
10,048,706 B2 * 8/2018 Hublou ..... G05D 23/1923
2008/0294291 A1 11/2008 Salsbury et al.
2012/0101648 A1 * 4/2012 Federspiel ..... G05D 23/1934 700/291
2012/0186774 A1 * 7/2012 Matsuoka ..... F24F 11/30 165/11.1
2012/0296479 A1 * 11/2012 Millar ..... G05D 23/1923 700/277
2013/0085614 A1 * 4/2013 Wenzel ..... G05D 23/1923 700/277
2013/0179373 A1 7/2013 Mutchnik et al.
2013/0247601 A1 9/2013 Burns et al.
2013/0268125 A1 * 10/2013 Matsuoka ..... G05D 23/1905 700/276
2014/0330611 A1 * 11/2014 Steven ..... G06Q 10/06314 705/7.24
2014/0330695 A1 * 11/2014 Steven ..... G06Q 30/0283 705/37
2015/0088576 A1 * 3/2015 Steven ..... G06Q 50/06 705/7.22
2015/0134123 A1 * 5/2015 Obinelo ..... F24F 11/006 700/277
2016/0305678 A1 * 10/2016 Pavlovski ..... G05B 13/048
2016/0377306 A1 * 12/2016 Drees ..... F24F 11/62 700/295
2017/0016642 A1 * 1/2017 Spalink ..... F24F 11/001
2017/0102162 A1 * 4/2017 Drees ..... F24F 11/0086
2017/0146256 A1 * 5/2017 Alexander ..... F24F 11/001
2017/0212482 A1 * 7/2017 Boettcher ..... F24F 11/30
2018/0004171 A1 * 1/2018 Patel ..... F24F 11/30
2018/0004172 A1 * 1/2018 Patel ..... F24F 11/54
2018/0004173 A1 * 1/2018 Patel ..... F24F 11/30
2018/0087790 A1 * 3/2018 Perez ..... F24F 11/56
2018/0216841 A1 * 8/2018 Steinberg ..... G05D 23/1923

* cited by examiner

SYSTEM AND METHOD FOR CONTROLLING MULTI-ZONE VAPOR COMPRESSION SYSTEMS

FIELD OF THE INVENTION

This invention relates to vapor compression systems, and more particularly to a system and a method for controlling a multiple-zone vapor compression system.

BACKGROUND OF THE INVENTION

Vapor compression systems (VCS) move thermal energy between a low temperature environment and a high temperature environment in order to perform cooling or heating operations in order to improve comfort of occupants in the environment. For example, heat can be moved from an indoor space to an outdoor space in order to lower the indoor temperature in a cooling operation, or heat can be moved from an outdoor space to an indoor space in order to raise the indoor temperature in a heating operation.

The heat load, or rate at which the thermal energy is moved into a space (e.g., by hot air passing into a building) is generally not directly measured, but its effect is detected as changes in the indoor space temperature or zone temperature. In order to control the zone temperature, the operations of the VCS modulates the cooling or heating capacity provided by the system to counteract the load such that the zone temperature is near a desired zone temperature. The thermal capacity of a heat exchanger is the rate at which the thermal energy is accepted or rejected by a heat exchanger.

A multi-zone vapor compression system (MZ-VCS) includes at least a single compressor connected to multiple heat exchangers arranged in one or more indoor zones. Conventionally, the heating or cooling capacity of such indoor heat exchangers is modulated by duty cycling each heat exchanger between "ON" and "OFF" modes of the operation. The heat exchanger is OFF when an inlet valve that controls refrigerant flow is closed or alternatively, the compressor that pumps refrigerant through the system is stopped, so that no cooling or heating is performed by the heat exchanger. The heat exchanger is ON when an inlet valve is opened and the compressor is operating so that the heat exchangers in the indoor zones operate at their full thermal capacity. A controller decides how to alternate between the modes based on a difference between the zone temperature and the desired zone temperature.

However, the act of switching heat exchangers ON and OFF, especially in MZ-VCS where the zone heat exchangers can be switched ON and OFF independently from each other, result in persistent variations in the outputs of the system, such as zone temperatures and heat exchanger temperatures, that are known to be energetically inefficient and reduce occupant comfort. Accordingly, there is a need in the art for a control system and method to smoothly control the thermal capacity of heat exchangers, such as the heat exchangers of MZ-VCS.

In addition to smoothly controlling the heat capacity within a heat exchanger in a multi-zone system, there is a need to control the overall operations of the multi-zone vapor compression system. For example, during the operation of the VCS, various constraints should be enforced. For example, certain maximum or minimum temperatures and pressures should not be violated for equipment safety. Some controllers enforce the constraints reactively, i.e., corrective action is taken once a dangerous situation is detected. The violations of the constraints can occur for some period of time while the system responds with corrective actions, and therefore the threshold at which corrective action is used is selected conservatively to account for violations that can occur. As a result, the controllers with reactive constraint management logic are often detuned away from the value of the constraints, which sacrifice the regions of highest performance, see, e.g., EP2469201.

Accordingly, there is a need in the art for a system and a method for an efficient control of MZ-VCS subject to constraints.

SUMMARY OF THE INVENTION

It is an object of some embodiments of the invention to provide a system and a method for controlling operations of a multi-zone vapor compression system (MZ-VCS). It is another object of some embodiments to provide a system and method for controlling a heat exchanger to deliver the thermal capacity requested from the heat exchanger without a need to induce oscillations or limits cycles switching the heat exchangers ON and OFF independently from each other. It is a further object of some embodiments to provide a system and method for controlling the thermal capacity of heat exchangers without requiring new actuators such as additional valves. It is another object of some embodiments of the invention to provide a system and method for controlling the vapor compression system predictively such that constraints on the operation of the MZ-VCS are satisfied.

A model predictive controller (MPC) is based on an iterative, finite horizon optimization of a cost function that describes the operation of the controlled system and has the ability to anticipate future events to take appropriate control actions. Some embodiments of the invention are based on recognition that MPC offers attractive properties for vapor compression system control including guaranteed enforcement of constraints, which in turn can be selected for performance that is more aggressive because the constraint enforcement is guaranteed.

However, the MPC requires an accurate prediction of all outputs of the MZ-VCS. Because the limit cycles perturb the outputs in unpredictable ways, the application of MPC to MZ-VCS is problematic. However, it was realized that the model of MZ-VCS can be modified to include linear relationship between thermal capacities of each heat exchangers and temperatures in a corresponding zone controlled by the heat exchanger, and additional capacity controllers can enforce such a linear relationship. The resulting dynamic response of temperatures and/or pressures in the MZ-VCS can therefore be modeled by simpler linear differential equations predicting the short-term future trends of these signals. These dynamic models are then suitable for predictive control strategies that calculate actuator commands based in part on a predicted response to those commands.

Furthermore, by smoothly controlling the thermal capacity of the heat exchangers, limit cycling and other periodic disturbances caused by the controller can be eliminated. For example, some embodiments are based on recognition that the thermal capacity of the heat exchangers can be controlled based on a continuous relationship among superheat temperatures on different paths of the heat exchangers for passing the refrigerant passing. This continuous relationship can help for eliminating the limit cycles and making the control more predictable. In turn, this predictability makes possible the usage of MPC based on a modified model of the MZ-VCS.

It is further recognized, that MPC requires an estimate of the state of the vapor compression system during its operation. Unfortunately, the complexity and cost of modern MZ-VCS make direct measurement of the state impractical. Therefore, the MPC of the MZ-VCS requires a method for estimating the states of the MZ-VCS under control, which generally requires measurements or estimation of a thermal load disturbance on the MZ-VCS. However, the thermal load is a dominant disturbance of the MZ-VCS that can be neither directly measured nor accurately predicted.

Some embodiments of the invention are based on the realization that an estimator that prioritizes state estimate accuracy is not necessary. Rather than combine noisy measurement information with uncertain model information to obtain an accurate state estimate, it is realized that if an estimator can be formulated in a way that prioritizes output estimate accuracy over state estimate accuracy, the need for measuring thermal load disturbances and obtaining accurate models of its influence on other signals can be avoided.

Specifically, in the context of the MZ-VCS, the need to measure or predict the thermal load disturbance can be avoided entirely by constructing a state estimator so that the difference between the predicted output and the measured output asymptotically approaches zero even in the presence of unmeasurable disturbances and model uncertainty. This prevents inaccuracies in the prediction model and ensures that the control inputs determined by the controller achieve the control objectives of the VCS. Because the influence of the thermal load is accounted for in non-physical auxiliary states in the estimator, there is no need to directly measure or model the thermal load. In this approach, the benefits of constraint enforcement and increased performance characteristics of model predictive control of vapor compression systems can be realized.

Accordingly, one embodiment discloses a multi-zone vapor compression system (MZ-VCS) includes a compressor connected to a set of heat exchangers controlling environments in a set of zones, wherein there is at least one heat exchanger for each zone; a supervisory controller including a processor determining a set of control inputs for controlling a vapor compression cycle of the MZ-VCS, wherein the supervisory controller is a model predictive controller (MPC) determining the set of control inputs using a model of the MZ-VCS including a linear relationship between thermal capacities of each heat exchanger and temperatures in a corresponding zone controlled by the heat exchanger; and a set of capacity controllers, wherein there is one capacity controller for each heat exchanger, each capacity controller enforces the linear relationship between the thermal capacity and the temperature in the corresponding zone.

Another embodiment discloses a multi-zone vapor compression system (MZ-VCS), including a set of heat exchangers configured for controlling environments in a set of zones, wherein there is at least one heat exchanger for each zone, wherein the heat exchanger includes an inlet header pipe connected to a set of paths for passing the refrigerant, and wherein the inlet header pipe splits the refrigerant into the set of paths; a supervisory controller including a processor configured for optimizing a cost function subject to constraints on an operation of the MZ-VCS to produce a set of values of the thermal capacity requested for the set of heat exchangers to achieve setpoint temperatures in the corresponding zones, wherein the supervisory controller is a model predictive controller (MPC) for determining the set of control inputs using a model of the MZ-VSC including a linear relationship between thermal capacities of each heat exchangers and temperatures in a corresponding zone controlled by the heat exchanger; and a set of capacity controllers, there is one capacity controller for each heat exchanger, wherein each capacity controller is configured for controlling the corresponding heat exchanger to achieve the requested thermal capacity.

Yet another embodiment discloses a method for controlling a multi-zone vapor compression system (MZ-VCS) including a set of heat exchangers configured for controlling environments in a set of zones, wherein the heat exchanger includes an inlet header pipe connected to a set of paths for passing the refrigerant, and wherein the inlet header pipe splits the refrigerant into the set of paths. The method includes receiving setpoint values for controlling environments in each zone; optimizing a cost function subject to constraints on an operation of the MZ-VCS to produce a set values of the thermal capacity requested for the set of heat exchangers to achieve the setpoint values in the corresponding zones, wherein the cost function is optimized for a future time horizon using a model of the MZ-VCS including linear relationships between thermal capacities of the heat exchangers and temperatures in the corresponding zone; determining, for each heat exchanger, a setpoint temperature of the refrigerant passing through the heat exchanger producing the requested thermal capacity; selecting a path from the set of paths for measuring temperature of the refrigerant; and adjusting, for each heat exchanger, a position of a valve controlling the refrigerant passing through the heat exchanger to reduce an error between the setpoint temperature of the refrigerant and a temperature of the refrigerant measured on the selected path, wherein at least some of steps of the method are performed by a processor.

Definitions

In describing embodiments of the invention, the following definitions are applicable throughout (including above).

A "computer" refers to any apparatus that is capable of accepting a structured input, processing the structured input according to prescribed rules, and producing results of the processing as output. Examples of a computer include a computer; a general-purpose computer; a supercomputer; a mainframe; a super mini-computer; a mini-computer; a workstation; a microcomputer; a server; an interactive television; a hybrid combination of a computer and an interactive television; and application-specific hardware to emulate a computer and/or software. A computer can have a single processor or multiple processors, which can operate in parallel and/or not in parallel. A computer also refers to two or more computers connected together via a network for transmitting or receiving information between the computers. An example of such a computer includes a distributed computer system for processing information via computers linked by a network.

A "central processing unit (CPU)" or a "processor" refers to a computer or a component of a computer that reads and executes software instructions.

A "memory" or a "computer-readable medium" refers to any storage for storing data accessible by a computer. Examples include a magnetic hard disk; a floppy disk; an optical disk, like a CD-ROM or a DVD; a magnetic tape; a memory chip; and a carrier wave used to carry computer-readable electronic data, such as those used in transmitting and receiving e-mail or in accessing a network, and a computer memory, e.g., random-access memory (RAM).

"Software" refers to prescribed rules to operate a computer. Examples of software include software; code segments; instructions; computer programs; and programmed logic. Software of intelligent systems may be capable of self-learning.

A "module" or a "unit" refers to a basic component in a computer that performs a task or part of a task. It can be implemented by either software or hardware.

A "control system" refers to a device or a set of devices to manage, command, direct or regulate the behavior of other devices or systems. The control system can be implemented by either software or hardware, and can include one or several modules.

A "computer system" refers to a system having a computer, where the computer comprises computer-readable medium embodying software to operate the computer.

A "network" refers to a number of computers and associated devices that are connected by communication facilities. A network involves permanent connections such as cables, temporary connections such as those made through telephone or other communication links, and/or wireless connections. Examples of a network include an internet, such as the Internet; an intranet; a local area network (LAN); a wide area network (WAN); and a combination of networks, such as an internet and an intranet.

A "vapor compression system" refers to a system that uses a vapor compression cycle to move refrigerant through components of the system based on principles of thermodynamics, fluid mechanics, and/or heat transfer.

An "HVAC" system refers to any heating, ventilating, and air-conditioning (HVAC) system implementing the vapor compression cycle. HVAC systems span a very broad set of systems, ranging from systems which supply only outdoor air to the occupants of a building, to systems which only control the temperature of a building, to systems which control the temperature and humidity.

"Components of a vapor compression system" refer to any components of the vapor compression system having an operation controllable by the control systems. The components include, but are not limited to, a compressor having a variable speed for compressing and pumping the refrigerant through the system; an expansion valve for providing an adjustable pressure drop between the high-pressure and the low-pressure portions of the system, and an evaporating heat exchanger and a condensing heat exchanger, each of which may incorporate a variable speed fan for adjusting the air-flow rate through the heat exchanger.

An "evaporator" refers to a heat exchanger in the vapor compression system in which the refrigerant passing through the heat exchanger evaporates over the length of the heat exchanger, so that the specific enthalpy of the refrigerant at the outlet of the heat exchanger is higher than the specific enthalpy of the refrigerant at the inlet of the heat exchanger, and the refrigerant generally changes from a liquid to a gas. There may be one or more evaporators in the vapor-compression system.

A "condenser" refers to a heat exchanger in the vapor compression system in which the refrigerant passing through the heat exchanger condenses over the length of the heat exchanger, so that the specific enthalpy of the refrigerant at the outlet of the heat exchanger is lower than the specific enthalpy of the refrigerant at the inlet of the heat exchanger, and the refrigerant generally changes from a gas to a liquid. There may be one or more condensers in a vapor-compression system.

A "setpoint" refers to a target value the system, such as the vapor compression system, aims to reach and maintain as a result of the operation. The term setpoint is applied to any particular value of a specific set of control signals and thermodynamic and environmental parameters.

"Heat load" refers to the thermal energy rate moved from a low temperature zone to a high temperature zone by the vapor compression system. The units typically associated with this signal are Joules per second or Watts or British Thermal Units per hour (BTUs/hr).

"Thermal capacity" refers to the energy rate absorbed by a heat exchanger in a vapor compression system. The units typically associated with this signal are Joules per second or Watts or British Thermal Units per hour (BTUs/hr).

DETAILED DESCRIPTION OF EMBODIMENTS OF INVENTION

Multi-Zone Vapor Compression System

Figure 1A:
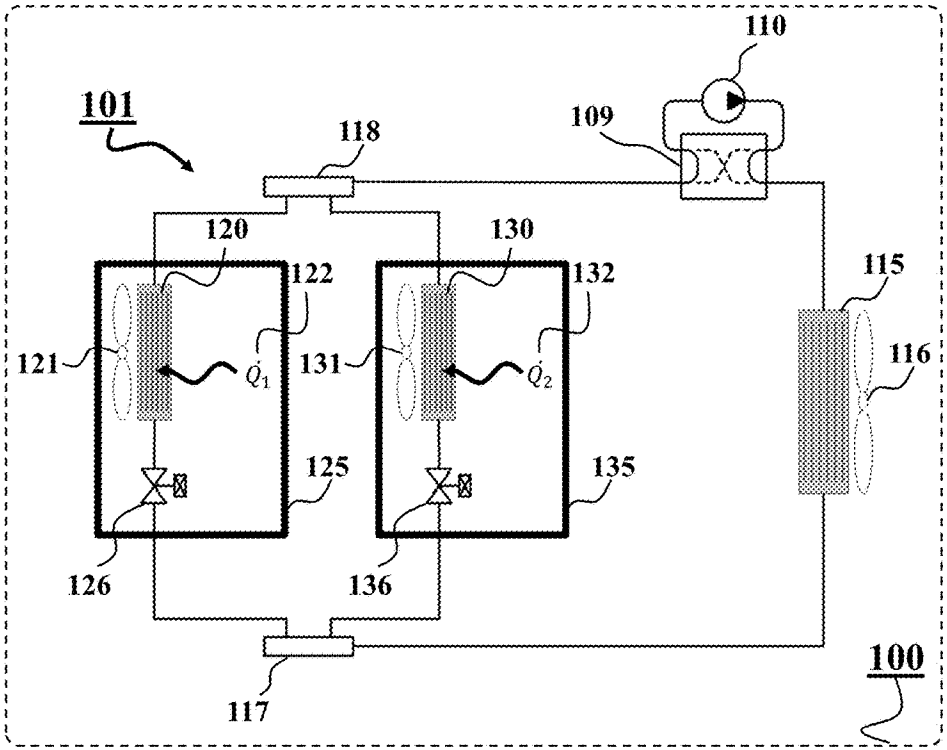
FIGS. 1A and 1B are block diagrams of a multi-zone vapor compression system (MZ-VCS) controlled according to principles employed by some embodiments of the invention.
Figure 1B:
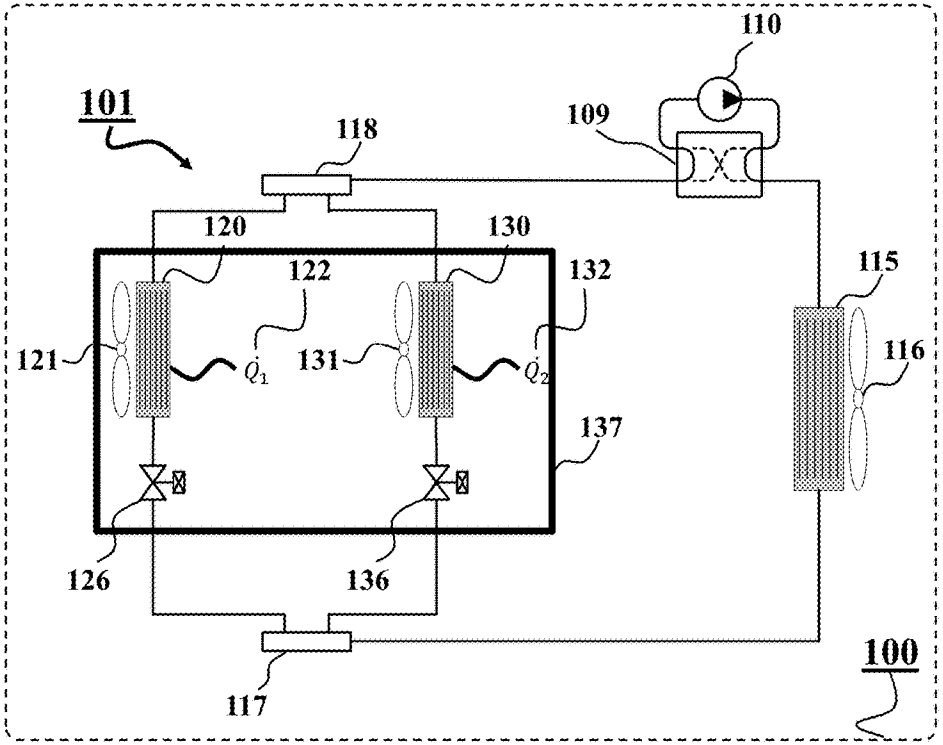

FIGS. 1A and 1B show block diagrams of a multi-zone vapor compression system (MZ-VCS) 100 controlled by a controller 101 according to principles employed by some embodiments of the invention. The MZ-VCS includes a compressor and a set heat exchangers configured for controlling environments in a set of zones. There is at least one heat exchanger for each zone. For example, in one embodiment of FIG. 1A, each zone 125 or 135 corresponds to a room in a building enabling the MZ-VCS to provide cooling or heating to multiple zones simultaneously. In alternative embodiment shown in FIG. 1B, multiple heat exchangers are placed in one room or zone 137 in a building enabling the MZ-VCS to provide cooling or heating to different sections of the room.

In this disclosure, a two-zone MZ-VCS is described for clarity, but it should be understood that any number of zones can be used, subject to the physical limitations of refrigerant line lengths, capacity and pumping power of the compressor, and building codes. If the zone is an indoor zone, such as a room or a portion of the room, the heat exchangers are indoor heat exchangers.

A compressor 110 receives a low-pressure refrigerant in a vapor state and performs mechanical work to increase the pressure and temperature of the refrigerant. Depending on the configuration of a four-way valve 109, the high temperature refrigerant can be routed to either an outdoor heat exchanger (in which case the system moves heat to the outside environment and is proving useful cooling and is said to operate in cooling mode) or to an indoor heat exchanger (in which case the system moves heat to one or more indoor zones and is proving useful heating and is said to operate in heating mode).

For clarity and in order to simplify the subsequent description, a cooling mode is generally considered, i.e., the compressor is connected to the rest of the vapor compression system as shown as solid lines of the four-way valve 109, but it should be understood that analogous statements can be made about the system operating in heating mode with appropriate substitutions of condenser for evaporator, condensing temperature for evaporating temperature.

In cooling mode, the high-temperature, high-pressure refrigerant moves to an outdoor heat exchanger 115 and an associated optional fan 116 blows air across the heat exchanger. Heat is transferred from the refrigerant to the air, causing the refrigerant to condense from a vapor to a liquid.

The phase change process wherein vapor refrigerant condenses from saturated vapor to a two-phase mixture of both liquid and vapor to saturated liquid is isothermal in ideal descriptions of the vapor compression cycle, that is, the phase change process occurs at a constant temperature and therefore without a sensible change in temperature. However, if further heat is removed from the saturated liquid, the temperature of the saturated liquid then decreases by an appropriate amount and the refrigerant is termed "subcooled." The subcool temperature is the temperature difference between the subcooled refrigerant and the calculated saturated liquid refrigerant temperature at the same pressure.

Liquid high temperature refrigerant exits the outdoor heat exchanger and is split by a manifold 117 in order to distribute the refrigerant between the subsequently connected indoor zones 125, 135 or 137. Separate expansion valves 126, 136 are connected to the inlet manifold. These expansion valves are restriction elements and cause the pressure of the refrigerant to be substantially reduced. Since the pressure is quickly reduced without substantial heat exchange in the valve, the temperature of the refrigerant is substantially reduced, termed "adiabatic" in ideal descriptions of the vapor compression cycle. The resulting refrigerant exiting the valves is a low pressure, low temperature two-phase mixture of liquid and vapor.

Two-phase refrigerant enters the indoor heat exchangers 120, 130 where associated fans 121, 131 blow air across the heat exchangers. Heat 122, 132 representing the thermal loads from the indoor spaces is transferred from the zones to the refrigerant, causing the refrigerant to evaporate from a two-phase mixture of liquid and vapor to a saturated vapor state.

The phase change process wherein refrigerant evaporates from a saturated vapor to a two-phase mixture of both liquid and vapor to saturated vapor is isothermal in ideal descriptions of the vapor compression cycle, i.e., occurs at a constant temperature and therefore is a process that occurs without a sensible change in temperature. However, if further heat is added to the saturated vapor, the temperature of the saturated vapor then increases by an appropriate amount and the refrigerant is termed "superheated." The superheat temperature is the difference between the superheated refrigerant vapor and the calculated saturated vapor temperature at the same pressure.

The low pressure refrigerant vapor exiting the indoor unit heat exchangers is rejoined to a common flow path at the outlet manifold 118. Finally, low pressure refrigerant vapor is returned to the compressor and the cycle repeats.

The principal actuators in the MZ-VCS 100 include the compressor 110, the outdoor heat exchanger fan 116, the indoor heat exchanger fans 121, 131 and the expansion valves 126, 136. In some systems, the compressor speed can be fixed to one or more predetermined settings, or varied continuously. Similarly, the outdoor heat exchanger fans can operate at fixed speeds or varied continuously. In some configurations, the indoor heat exchanger fans can be determined by the MZ-VCS controller, or its speed can be determined by the occupants when the occupants wish to directly control indoor airflow. The expansion valves are controlled, e.g., electronically-controlled, by the controller 101 to continuously vary from being in fully closed to fully open positions including all possible intermediate positions. Some MZ-VCS implementations substitute electronically-controlled expansion valves with a series combination of a solenoid valve for on/off control, and a separate variable opening valve for precise flowrate control.

The high and low refrigerant pressures are determined by thermodynamic conditions such as outdoor and indoor air temperature, the compressor speed and the joint combination of valve openings. The expansion valves can each be set to different openings, but the overall high and low pressures are determined by the total pressure drop across these valves, which are arranged in parallel in the refrigerant circuit. Note that there are no pressure reducing elements between the indoor heat exchangers 120, 130 and the outlet manifold 118, and therefore all heat exchangers operate at substantially the same pressure. Moreover, due to the previously mentioned isothermal characteristic of phase change, all indoor heat exchangers are constrained to evaporate at the same temperature. This common evaporating temperature Te, represents an important constraint in the operations of MZ-VCS, as explained below.

Figure 1C:
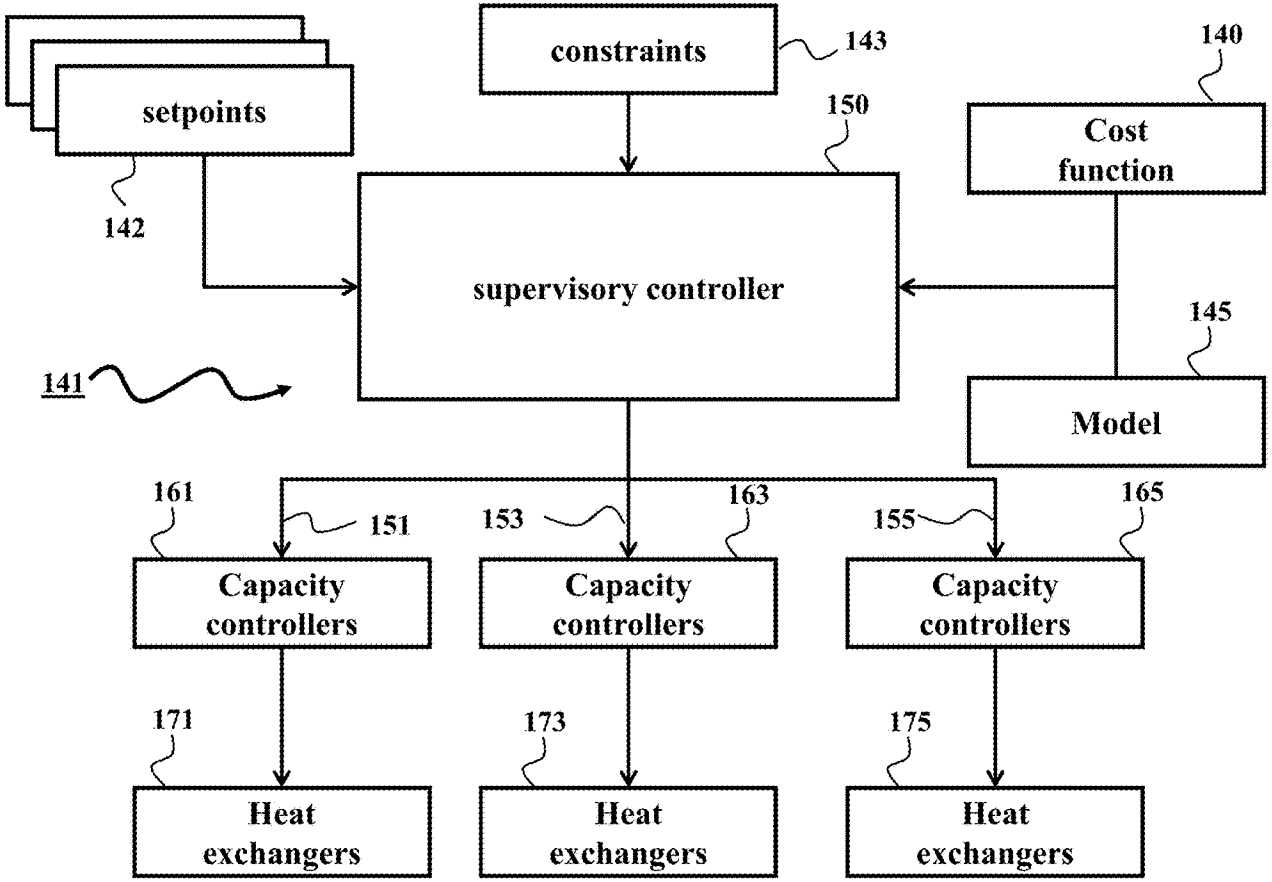
FIG. 1C is a block diagram of a control system for controlling the MZ-VCS according to one embodiment of the invention.

FIG. 1C shows a block diagram of a control system for controlling the MZ-VCS according to one embodiment of the invention. The MZ-VCS includes a compressor connected to a set heat exchangers configured for controlling environments in a set of zones, such that there is at least one heat exchanger for each zone. The control system can be implemented using a processor 141.

The control system includes a supervisory controller 150 configured for determining a set of control inputs for controlling the vapor compression cycle. The supervisory controller 150 is a model predictive controller (MPC) for determining the set of control inputs using a model 145 of the MZ-VSC. In various embodiments of the invention, the model 145 is modified to include a linear relationship between thermal capacities of each heat exchangers and temperatures in a corresponding zone controlled by the heat exchanger. Due to this modification, the resulting dynamic response of temperatures and/or pressures in the MZ-VCS can therefore be modeled by simpler linear differential equations predicting the short-term future trends of these signals. These dynamic models are then suitable for predictive control strategies that calculate actuator commands based in part on a predicted response to those commands.

In some embodiments, the supervisory controller 150, in response to receiving a set of setpoints 142 for desired temperature in the set of controlled zones, optimizes a cost function 140 subject to constraints 143 on an operation of the MZ-VCS to produce a set of values of the thermal capacity 151, 153, and 155. Those thermal capacities are determined to achieve the requested setpoints by corresponding heat exchangers 171, 173, and 175. Advantageously, the supervisory controller can jointly determine the thermal capacities to optimize some metric of performance and/or to enforce the constraints on different components of the MZ-VCS.

In addition, the control system includes a set of capacity controllers 161, 163, and 165. There is one capacity controller for each heat exchanger configured for enforcing the linear relationship between the thermal capacity and the temperature in the corresponding zone. For example, the capacity controller 161 controls the heat exchanger 171 to produce the requested thermal capacity 151. Similarly, the capacity controller 163 controls the heat exchanger 173 to produce the requested thermal capacity 15 and the capacity controller 165 controls the heat exchanger 175 to produce the requested thermal capacity 155.

Each capacity controller independently controls the corresponding heat exchanger to enforce the linear relationship between the thermal capacity and the temperature in the corresponding zone. Such an independent control allows to predictably use the MPC for optimizing control inputs while enforcing the constraints. However, such an independent control also faces a number of difficulties due to the coupling among the heat exchanger in MZ-VCS, as described below.

Problem Overview

The heat loads in each zone are independent, and the desired zone temperatures can be different. As a result, the cooling provided by each heat exchanger is independently controlled by some embodiments in order to meet these distinct thermal requirements. However, this requirement for independent thermal capacity is at odds with the common evaporating temperature constraint. For example, changing one valve opening in order to affect the local zone temperature causes the evaporating temperature in all zones to change. Further, while the zone temperature can be influenced by modulating the indoor heat exchanger fan speeds, this method cannot be relied upon because in some application the occupants of the zone are able to specify zone airflow settings independently from zone temperature settings.

In order to achieve independent zone temperatures in a multi-zone air conditioner constrained by a common evaporating pressure, conventional control strategies identify those indoor heat exchangers that need less cooling (e.g., those zones wherein the zone temperature is below the setpoint temperature and therefore overcooled) and temporarily cut off the flow of refrigerant to those heat exchangers by closing the expansion valves.

Figure 2A:
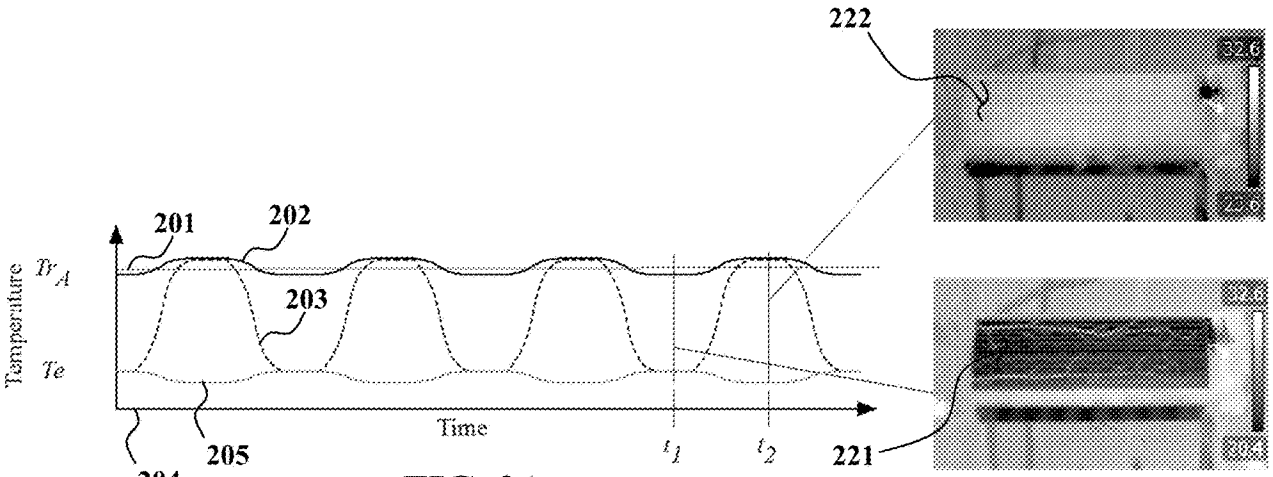
FIG. 2A Prior Art
FIGS. 2A and 2B are schematics of the temperature response as function of time for a conventional control method.
Figure 2B:
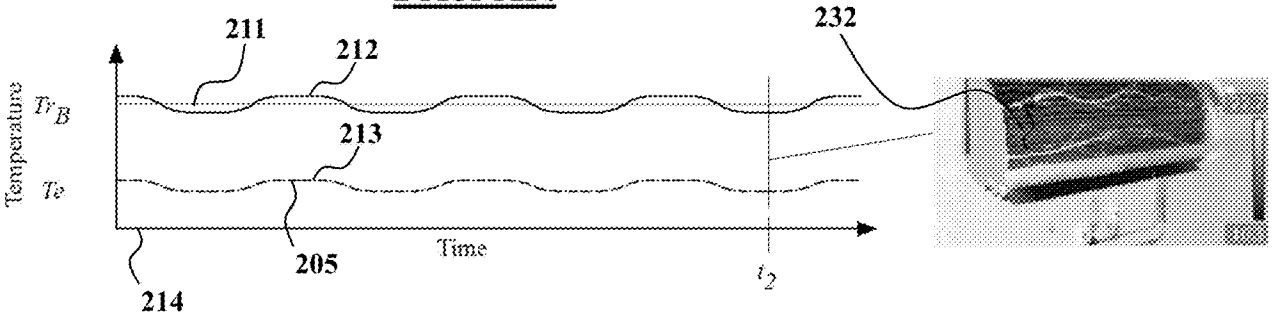
FIG. 2B Prior Art

FIGS. 2A and 2B show the temperature response as function of time as an example of a conventional control method used in prior art. In this example, two zones are considered over the same period. The conditions in zone of FIG. 2A require less cooling than the heat exchanger nominally supplies, and the heat load in zone of FIG. 2B is substantially in thermal equilibrium with the cooling provided by the associated heat exchanger. The images 221, 222, and 232 are thermographic images of the heat exchangers temperature as pixel intensity, where in this case darker pixels represent colder temperatures.

Because zone of FIG. 2A is overcooled, the expansion valve alternates between open and closed, and the heat exchanger surface temperature 203 oscillates between the evaporating temperature Te 205, and the zone temperature $Tr_A$ 202. When the expansion valve is open, the entire heat exchanger 221 is at the evaporating temperature as shown at time $t_1$ in the image 221. Conversely, when the expansion valve is closed, the heat exchanger warms to the zone temperature as shown at time $t_2$ in the image 222. As a result of this ON/OFF duty cycling, the zone temperature oscillates around the zone setpoint temperature 201, indicating that the cooling capacity of the heat exchanger averaged over some time window has been modulated to approximately equal the load.

In this example, the zone of FIG. 2B is in thermal equilibrium, meaning that the heat load is substantially equivalent to the cooling capacity, and therefore the zone temperature is approximately constant when averaged over some time window. However, the on/off cycling of the expansion valve of the heat exchanger for the zone of FIG. 2A causes variations in the system evaporating pressure and therefore of the evaporating temperature 205 which is coincident with the heat exchanger temperature 213. This oscillation in evaporating temperature in turn causes oscillation 212 of the temperature in the zone of FIG. 2B. Despite these fluctuations, the thermographic behavior in the zone of FIG. 2B over time largely resembles the image 232 taken at time $t_2$.

The control method used in the prior art, wherein the expansion valves are abruptly opened and closed, induces oscillation in the system evaporating temperature and refrigerant flow rate. Further, because the vapor compression cycle is strongly coupled, changes in evaporating temperature and refrigerant flow rate cause disturbances in many other areas of the machine, e.g., compressor discharge temperature and condensing pressure. Further, these cyclic disturbances are often not transient, but instead persist as limit cycles. Fluctuations induced by the limit cycles can degrade the ability of the machine to smoothly regulate zone temperatures, cause excessively high or low temperatures during peaks of the limit cycle, and consume energy unnecessarily as heat exchangers operating during sharp transients are known to be inefficient. Further, these oscillations cause disturbances in system temperature and pressures that are difficult to model with simple linear differential equations, and therefore preclude the use of predictive control strategies.

The duty cycling control of the heat exchanger can be avoided if there is a relationship between the opening of the valve and the requested thermal capacity of the heat exchanger. However, determining a fixed mapping from valve opening to heat exchanger capacity is difficult.

Figure 2C:
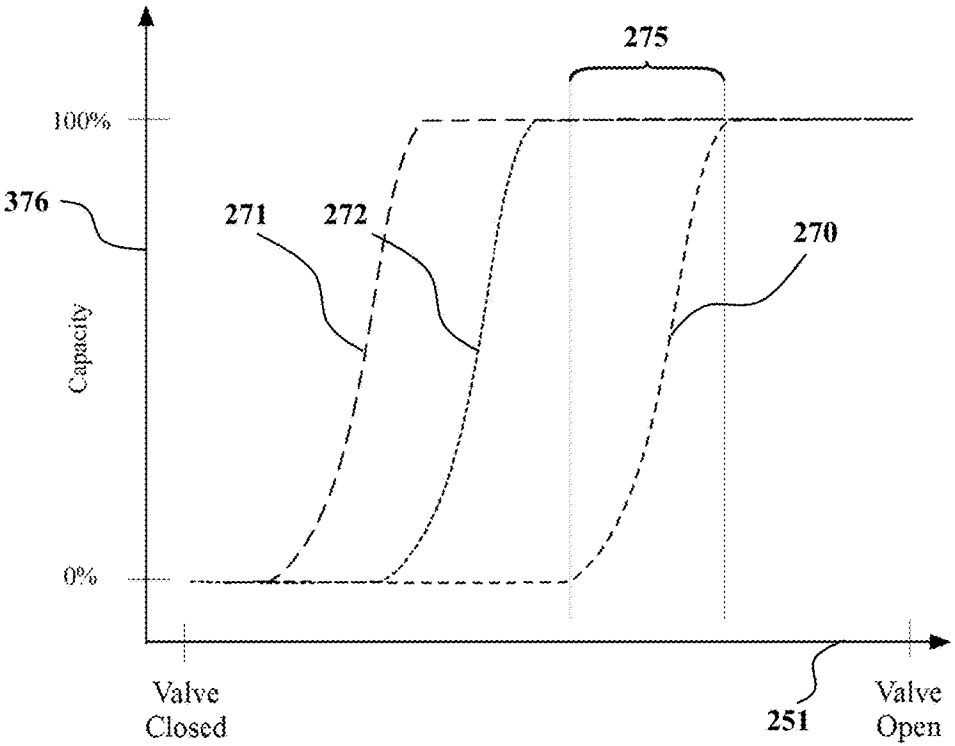
FIG. 2C is a hypothetical mapping between the valve openings and the thermal capacity of the heat exchanger.

FIG. 2C shows a hypothetical mapping 270 between the valve openings 251 and the thermal capacity 276 of the heat exchanger. It was realized, that such a mapping depends on thermodynamic conditions and varies over time. For example, the mapping 270 changes for a different set of outdoor air temperature, indoor zone temperatures, heat loads, and configuration of the vapor compression system. FIG. 2C shows three examples of such mappings 270, 271, 272 for different sets of thermodynamic conditions.

Unfortunately, the relationship between thermal capacity and opening of the valve is sensitive to disturbances. Furthermore, the thermodynamic conditions interact nonlinearly with the mapping, so that predicting how these conditions affect the map is difficult, and determining how the thermodynamic conditions influence the mapping through direct experimentation is so time consuming as to be impractical. Therefore it is not practical to control thermal capacity of a heat exchanger based on a direct mapping between valve opening and thermal capacity.

Solution Overview

Some embodiments aim to control opening of the valves admitting refrigerant into the heat exchangers based on a temperature of the refrigerant in the corresponding heat exchanger. Due to the physics of the state of the refrigerant passing through the heat exchanger, only superheat and subcool temperatures of the refrigerant can be measured. However, the region with superheat or subcool temperatures of the refrigerant in a single path across the heat exchanger corresponds only to a fraction of values of the thermal capacity formed by different openings of the valve, which makes temperature sensing an inefficient control variable.

However, in multi-path heat exchangers, a flow rate of refrigerant is different for each path, and the flow often prefers some paths more than others. It was realized that this preferential flow pattern is repeatable and measurable with sensors placed along the individual paths. Uneven distribution of refrigerant mass within a multi-path heat exchanger results in different superheat or subcool points for different paths. Thus, different sensors in different paths can measure the superheat for different values of cooling capacity that covers the entire range of the position of the valve.

To achieve the goal of smoothly and continuously controlling the evaporating cooling capacity, an observed behavior of refrigerant mass distribution in multi-path heat exchangers is exploited for control purposes by various embodiments of the invention.

Figure 3A:
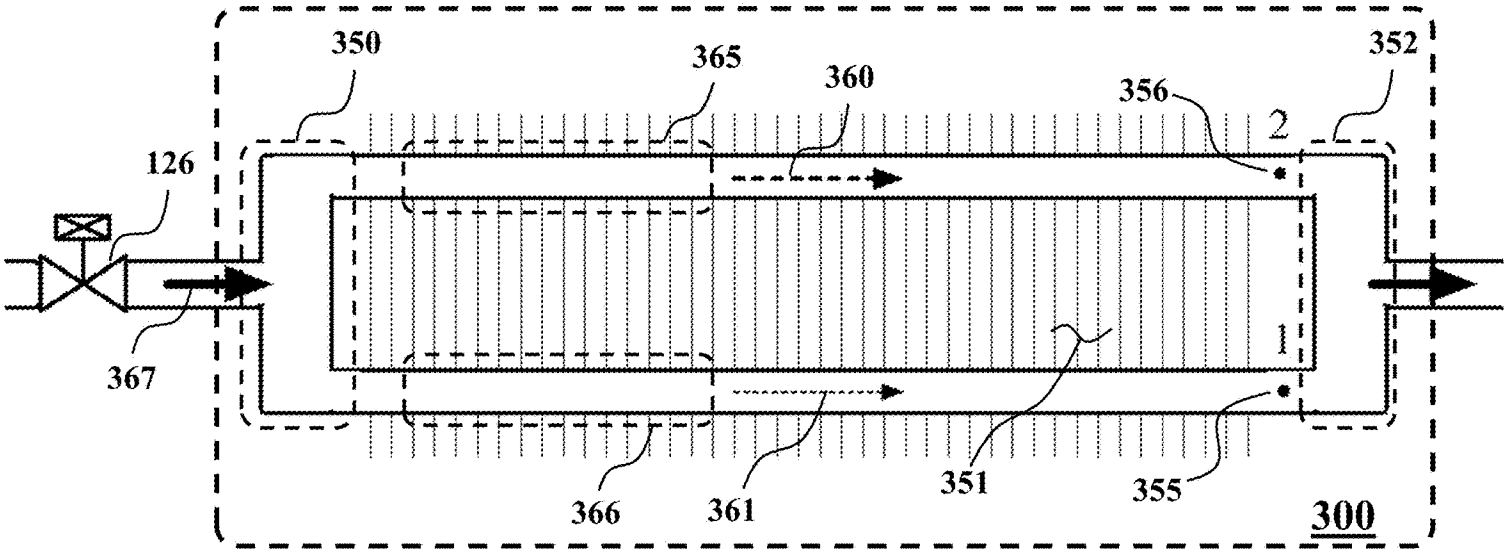
FIG. 3A is a schematic of a multi-path heat exchanger controlled according to various embodiments of the invention.

FIG. 3A shows a schematic of a multi-path heat exchanger 300 controlled by various embodiments of the invention. The multi-path heat exchanger 300 includes an inlet header pipe 350 that splits incoming refrigerant 367 between two or more paths 365, 366 through the heat exchanging fins 351 and collects those paths into a common outlet header pipe 352. While a two-path heat exchanger is described herein for clarity and brevity, different embodiments use different numbers of paths in a multi-path heat exchanger.

As the expansion valve 126 opening is decreased, the refrigerant mass flow rate entering the heat exchanger is reduced. At some low value of mass flow rate, refrigerant preferentially flows in some paths 360 more than others 361, causing uneven refrigerant distribution in the heat exchanger. This phenomenon of uneven refrigerant distribution is used by the embodiments for capacity control.

Uneven distribution of refrigerant mass within a multi-path heat exchanger can be detected by placing temperature sensors along the different paths, for example, see sensors labeled (1) 355 and (2) 356. In paths with low refrigerant mass flow rates, the two-phase liquid-vapor mixture that enters the heat exchanger completes the evaporation process at some point along the path and becomes superheated, which is sensible by the temperature sensors. The superheat temperature is the difference between the temperature of the saturated vapor refrigerant and the two-phase evaporating temperature, Te. For example, sensor (1) is placed on a path that has reduced refrigerant mass flow rate compared to the other path that includes sensor (2).

Figure 3B:
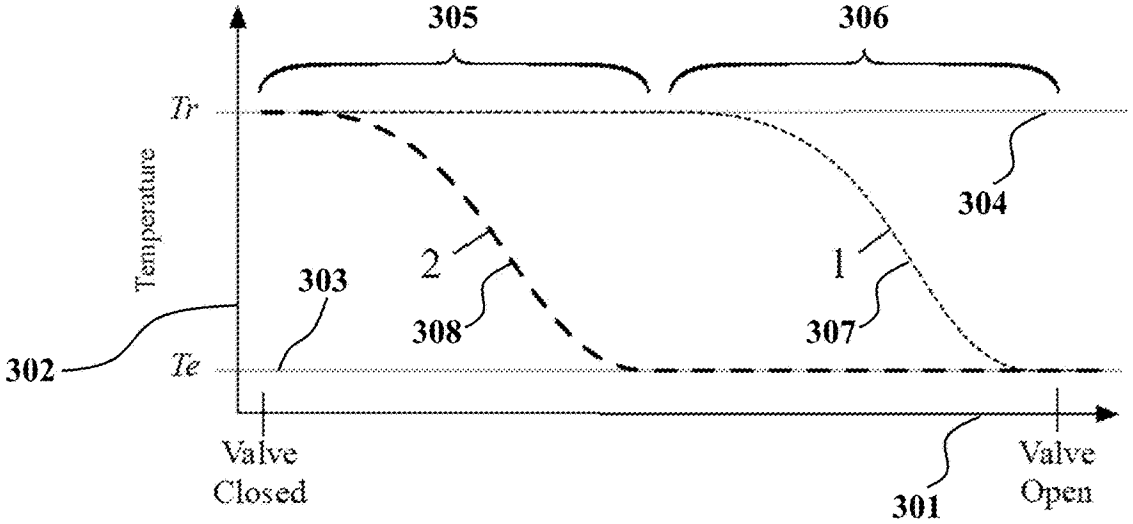
FIG. 3B is a schematic of a temperature response of refrigerant in different paths of a multi-path heat exchanger used by some embodiments.

FIG. 3B shows the temperature response of refrigerant in different paths of a multi-path heat exchanger exploited by some embodiments. As the expansion valve 301 is decreased, the sensible temperature at sensor (1) 307 is increased from the saturated evaporating temperature, Te 303. Eventually, the temperature at sensor (1) is increased until that part of the heat exchanger coil has reached the zone air temperature, Tr 304. The temperature of the heat exchanger is bounded by the evaporating temperature at the low end, and the room temperature at the high end.

In the region label 306, as the temperature measured by sensor (1) is increasing from Te to Tr, the temperature measured by sensor (2) 308 remains saturated at Te, because that path of the heat exchanger remains filled with two-phase refrigerant. In this region, because one path has superheated refrigerant and the other path has refrigerant at the evaporating temperature, the cooling capacity of the overall heat exchanger is relatively high.

As the expansion valve is closed further, the temperature measured by sensor (2) begins to increase from Te to Tr, while the temperature measured by sensor (1) remains saturated at Tr as shown in region labeled 305. In this region, one path has superheated refrigerant and the other path has refrigerant at the room temperature, and the thermal capacity of the overall heat exchanger is relatively low. Therefore, the thermal capacity of the entire heat exchanger can be smoothly varied from relatively high to relatively low by controlling the opening of the expansion valve.

Some embodiments of the invention are based on the realization that this preferential flow pattern is repeatable and results in different superheat or subcool points for different paths. Thus, different sensors in different paths can measure the superheat for different values of cooling capacity that covers the entire range of the position of the valve. Therefore, by controlling the path temperatures based on the relationship of FIG. 3B, the thermal capacity is not sensitive to thermodynamic conditions and can be modulated indirectly in a repeatable manner.

Figure 3C:
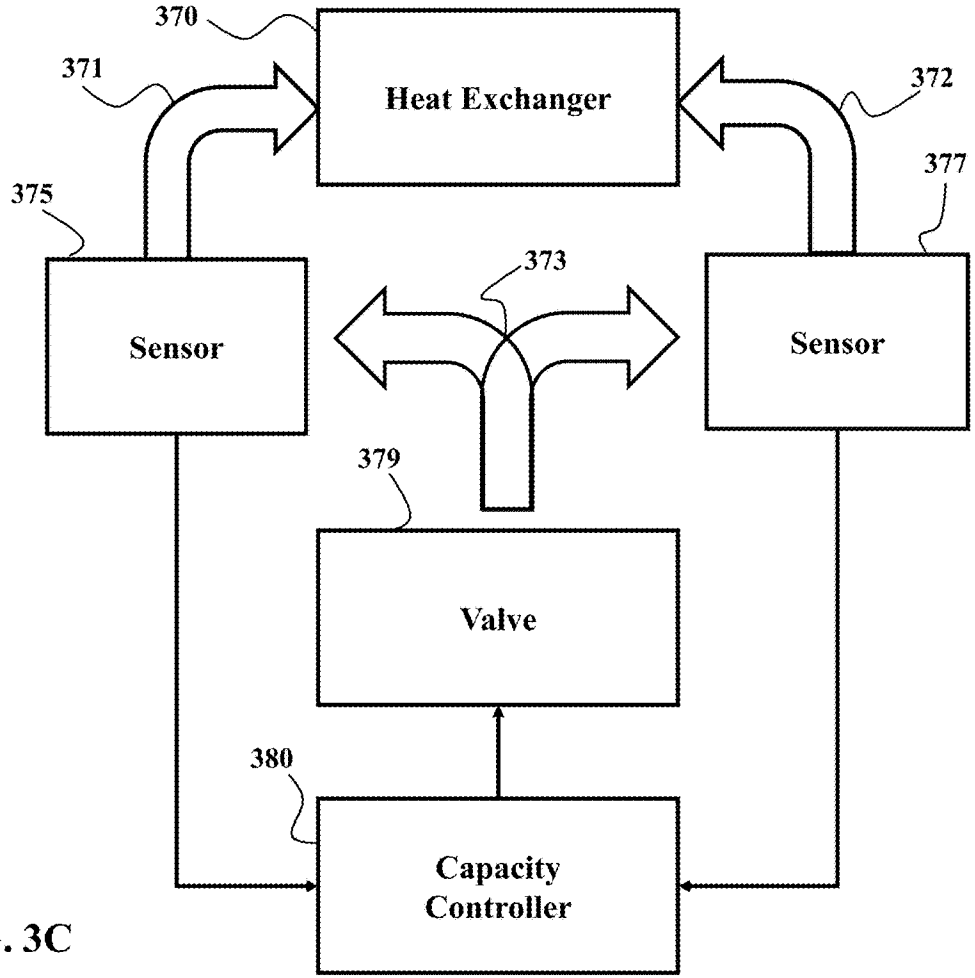
FIG. 3C is a block diagram of vapor compression system (VCS) according to some embodiments of the invention.

FIG. 3C shows a block diagram of VCS according to some embodiments of the invention. The VCS includes a heat exchanger 370 having an inlet header pipe 373 connected to a set of paths for passing refrigerant to condition a controlled zone. For example, the set of path includes a first path 371 and a second path 372. The inlet header pipe 373 splits the refrigerant into different paths from the set of paths, e.g., into the first and the second paths. The VCS also includes a set of sensors for measuring temperature of the refrigerant in each path of the set of paths. For example, the VCS includes a first sensor 375 for measuring temperature of the refrigerant on the first path 371 and includes a second sensor 377 for measuring temperature of the refrigerant on the second path 372.

The VCS also includes a valve 379 for controlling an amount of the refrigerant entering the inlet header pipe 373 and a controller 380 including a processor for determining a position of the valve based on the measurements of at least one sensor from the set of sensors and a thermal capacity requested for the heat exchanger.

In such a manner, the modulation of the thermal capacity is based on a continuous relationship of path temperatures and not on alternating between two discrete ON and OFF modes of operation, the changes in thermal capacity are smooth, which avoids limit cycling characteristics, and the position of the valve asymptotically approach the position corresponding to the requested thermal capacity.

Figure 3D:
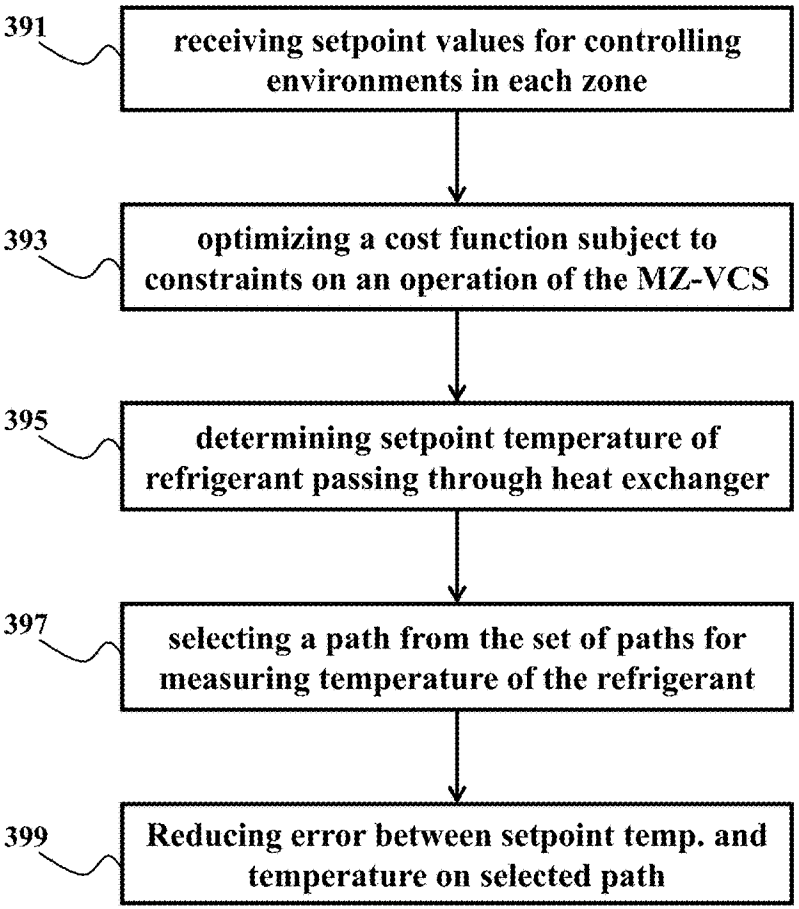
FIG. 3D is a flow chart of a method for controlling a MZ-VCS according to one embodiment of the invention

FIG. 3D shows a flow chart of a method for controlling a MZ-VCS according to one embodiment of the invention. The MZ-VCS includes a set of heat exchangers configured for controlling environments in a set of zones. The heat exchanger includes an inlet header pipe connected to a set of paths for passing the refrigerant. The inlet header pipe splits the refrigerant into the set of paths The method receives 391 setpoint values for controlling environments in each zone and optimizes 393 a cost function subject to constraints on an operation of the MZ-VCS to produce a set values of the thermal capacity requested for the set of heat exchangers to achieve the setpoint values in the corresponding zones. The cost function is optimized for a future time horizon using a model of the MZ-VSC including linear relationships between thermal capacities of the heat exchangers and temperatures in the corresponding zone.

Next, the method determines 395, for each heat exchanger, a setpoint temperature of the refrigerant passing through the heat exchanger producing the requested thermal capacity. For example, the method can determine the setpoint temperature of the refrigerant using a setpoint function mapping values of the requested thermal capacity to values of the temperature of refrigerant. In some implementations, the setpoint function is a continuous function that switches at a point of saturation of the temperatures of the refrigerant at each path in the set of paths.

Next, the method selects 397 a path from the set of paths for measuring temperature of the refrigerant and adjusting, for each heat exchanger, a position of a valve controlling the refrigerant passing through the heat exchanger to reduce an error between the setpoint temperature of the refrigerant and a temperature of the refrigerant measured on the selected path. A processor, such as the processor 141, performs at least some steps of the method.

Exemplar Control System

Figure 4A:
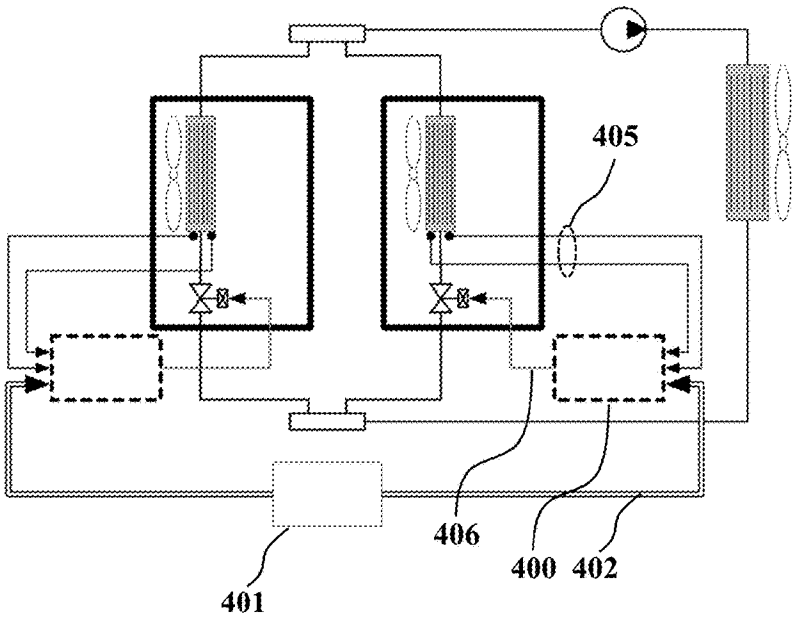
FIG. 4A is a block diagram of a controller for controlling MZ-VCS according to one embodiment of the invention.

FIG. 4A shows a block diagram of a controller for controlling MZ-VCS according to one embodiment of the invention. The controller of this embodiment includes a supervisory controller 401 for determining the thermal capacity needed for achieving the temperature requested for the controlled zone and a capacity controller 400 for determining a setpoint temperature of the refrigerant passing through at least one path of the heat exchanger and for adjusting the position of the valve reducing an error between the setpoint temperature and the measured temperature of the refrigerant in the path. In some embodiments, the MZ-VCS includes an outdoor heat exchanger, a set of indoor heat exchangers and a set of capacity controllers, such that there is one capacity controller for each indoor heat exchanger.

The capacity controller 400 receives signals from temperature sensors 405 arranged on paths of a multi-path heat exchanger and a capacity command providing the requested thermal capacity 402 determined by the supervisory controller 401. The capacity controller provides command signals 406 to adjust the position of the expansion valve such that the capacity of the heat exchanger is driven to the requested thermal capacity 402.

Figure 4B:
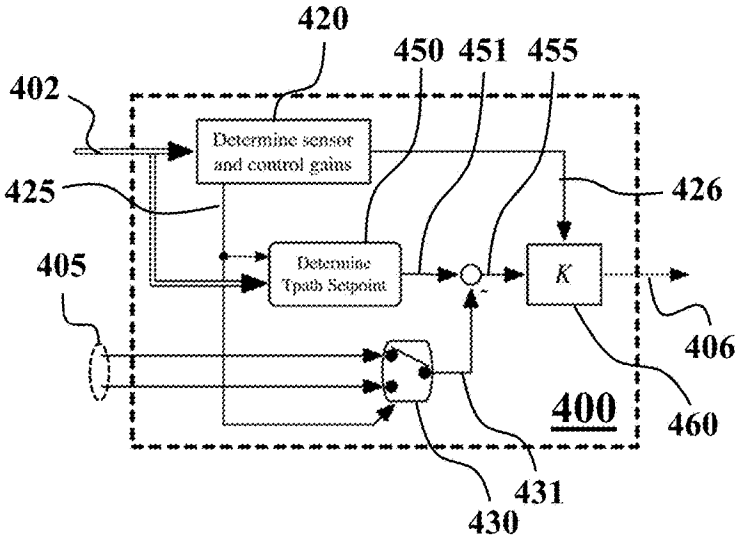
FIG. 4B is a block diagram of an exemplar embodiment of a capacity controller.

FIG. 4B shows a block diagram of an exemplar embodiment of a capacity controller 400. The capacity controller includes a regulator or feedback controller 460 that determines expansion valve commands 406 such that an error signal 455 indicative of an error between the setpoint temperature and the measured temperature of the refrigerant in the path is driven to zero. The feedback controller can be implemented as a proportional-integral-derivative (PID) controller, or some other type of a regulator. The feedback controller regulates the temperature of a sensor positioned on a selected path of the multi-path heat exchanger to a setpoint 451. The particular path to be controlled is determined by a processor executing a setpoint function 420 according to the capacity command 402.

In one embodiment, the feedback controller parameters or gains used in the feedback controller 460 can change based on the selected path. In this embodiment, control gain information 426 is provided by the setpoint function 420 to the feedback controller. This function 420 further provides information 425 to a routine 450 that determines the setpoint for the selected temperature sensor and sets the state of a switch 430 that selects which sensor is used to compute the error signal 455 provided to the feedback controller.

Figure 4C:
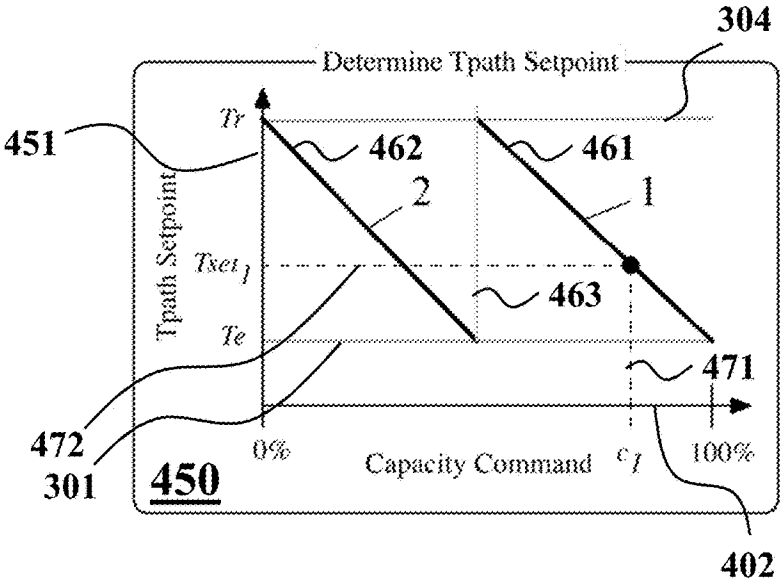
FIG. 4C is an illustration of the setpoint function for determining the setpoint for the selected path according to one embodiment of the invention.

FIG. 4C shows an illustration of the setpoint function used by the routine 450 for determining the setpoint for the selected path according to one embodiment of the invention. Information about the selected path 425 is provided to the routine, which uses this information to select from among the setpoints relationships 461, 462.

In various embodiments, the setpoint function partitions a space of the thermal capacity of the heat exchanger in a set of regions, there is one region for each sensor in the set, such that the requested thermal capacity is mapped by the setpoint function to the setpoint temperature of the selected sensor of a corresponding region. For example, a segment or a relationship 462 of the setpoint function corresponds to the region 305 of the example of FIG. 3B. Similarly, a segment or a relationship 461 of the setpoint function corresponds to the region 306. To that end, the setpoint function is a continuous function that switches 463 at a point of a saturation of the sensors in the set of sensors. Such a construction of the setpoint function allows using the correct sensor corresponding to the requested cooling capacity.

For example, if a relatively high cooling capacity is commanded, the function 420 selects the path containing sensor (1) 307, and the routine selects the setpoint relationship associated with the segment 461. The relationship 461 represents a setpoint for sensor (1) and its specific value depends on the capacity command 402. For example, if the capacity command is $c_1$ 471 and is a relatively high capacity command so that relationship 461 is used, then the setpoint for sensor (1) is determined to be $Tset_1$ 472. For a predetermined transition value of capacity command 463, another path is selected and therefore another relationship is used to determine the corresponding sensor setpoint. The example embodiment shown in FIG. 4C pertains to operation in cooling mode. Analogous embodiments are possible for operation in heating mode with suitable substitutions of condensing temperature for evaporating temperature 301, and a modification of the slopes of the setpoint relationships 461, 462.

In cooling mode, the determined setpoint for the selected path temperature sensor is bounded by the evaporating temperature 301 and the corresponding zone temperature 304. Note that these temperatures bounds depend on thermodynamic conditions and therefore can vary with time. For example, the processor of the controller can update the setpoint function in response to a change in the evaporating, condensing or the zone temperatures. By specifying the path temperature setpoint relationships as a function of these time varying bounds, the capacity of the overall heat exchanger is determined independently of thermodynamic conditions.

Figure 5:
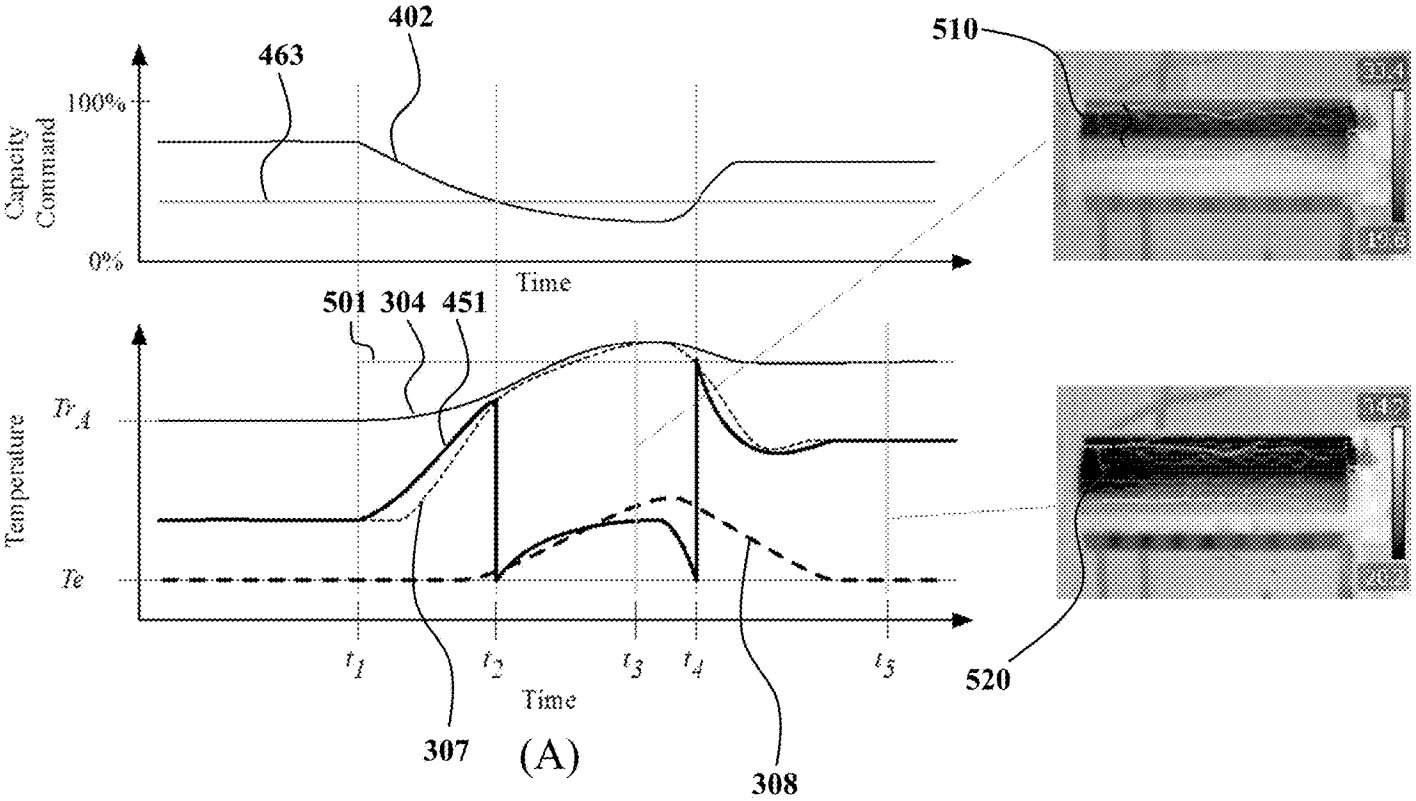
FIG. 5 is an illustration of an example transient in cooling mode of smooth capacity control using an embodiment of the invention.

FIG. 5 shows an example transient in cooling mode of smooth capacity control using an embodiment of the invention. The capacity command 402 is shown in the top plot and is determined by the supervisory controller 401. For example, the supervisory controller modulates the thermal capacity of the heat exchanger in order to drive the zone temperature 304 to a zone setpoint temperature 501, as shown in the bottom plot.

For this example, the initial conditions in this zone are such that steady state occurs with the heat exchanger at a relatively high thermal capacity, and the path setpoint temperature 451 is coincident with the path temperature corresponding to sensor (1) 307 shown as the heavy solid line 451 representing the path setpoint temperature coincident with the thin dashed line 307 representing the temperature measured by sensor (1) in the time leading up to $t_1$. This condition corresponds to the relatively high capacity region 306 of FIG. 3B.

At time $t_1$, the zone setpoint temperature 501 is increased, for example in response to an occupant increasing the setpoint temperature of a thermostat. The supervisory controller determines that the corresponding zone is therefore overcooled, and the capacity command 402 is reduced accordingly. As the capacity command is reduced between times $t_1$ and $t_2$, the path setpoint temperature 451 is increased and ultimately approaches the zone temperature upper bound. The feedback controller 460 part of the capacity controller 400 determines expansion valve commands such that the selected path temperature 307 is driven to the path setpoint temperature 451. This has the effect of smoothly reducing the thermal capacity of the heat exchanger and gradually raising the zone temperature.

At time $t_2$, the zone is still overcooled, but the path monitored by the sensor (1) has reached the zone temperature upper bound. Therefore, the setpoint function 420 selects the sensor (2) and changes the state of the switch 430, and the routine that determines the path setpoint temperature 450 determines the setpoint temperature for sensor (2). This is shown in FIG. 5 as an abrupt change in the path setpoint temperature 451 at time $t_2$, which occurs when the capacity command crosses a predetermined transition value 463. Because both the path setpoint temperature and the selected sensor are switched at the same time and in such a way as to ensure that the error signal provided to the feedback controller is smooth and continuous, the command provided to the expansion valve is smooth and continuous.

From time $t_2$ to $t_4$, the path corresponding to sensor (2) is used by the capacity controller to determine expansion valve commands. In FIG. 5, this is shown as the heavy solid line 451 representing the path setpoint temperature substantially coincident with the thick dashed line 308 representing the temperature measured by sensor (2). This condition corresponds to the relatively low capacity region 305 of FIG. 3B. Also within this time period the zone has become overheated, so the supervisory controller begins to increase the capacity command. At time $t_4$, the capacity command crosses the predetermined transition value 463 and the other path is selected for control.

Two instances from this period are selected as examples for thermographic images in order to illustrate the novel way in which the heat exchangers are controlled in this invention.

At time $t_3$ when the capacity command is relatively low, one path of the heat exchanger is at the zone temperature while the other is selected for capacity control. This situation is shown as a thermographic image 510. The heat exchanger surface temperature in the image 510 is partially at the evaporating temperature (shown as darker pixels) and some relatively large part of the heat exchanger is at the zone temperature.

At time $t_5$ when the capacity command is relatively high, one path of the heat exchanger is at the evaporating temperature while the other is selected for capacity control. This situation is shown as a thermographic image 520. The heat exchanger surface temperature in the image 520 is also partially at the evaporating temperature (shown as darker pixels) and some relatively small part of the heat exchanger is at some temperature between the two bounds.

The capacity control of indoor heat exchangers described above eliminates the limit cycle disturbances characteristic of traditional ON/OFF control methods found in prior art. As a result, the response from a capacity setpoint command to a zone temperature is linear and can be described by a set of time-invariant ordinary differential equations. The capacity controller therefore serves as a linearizing feedback element, and from the perspective of the supervisory controller 401, the response from capacity setpoint 402 to zone temperature 201, 211 is linear and predictable, and therefore enables the application of a suitably designed model predictive controller as described below.

Supervisory Model Predictive Controller

Figure 6:
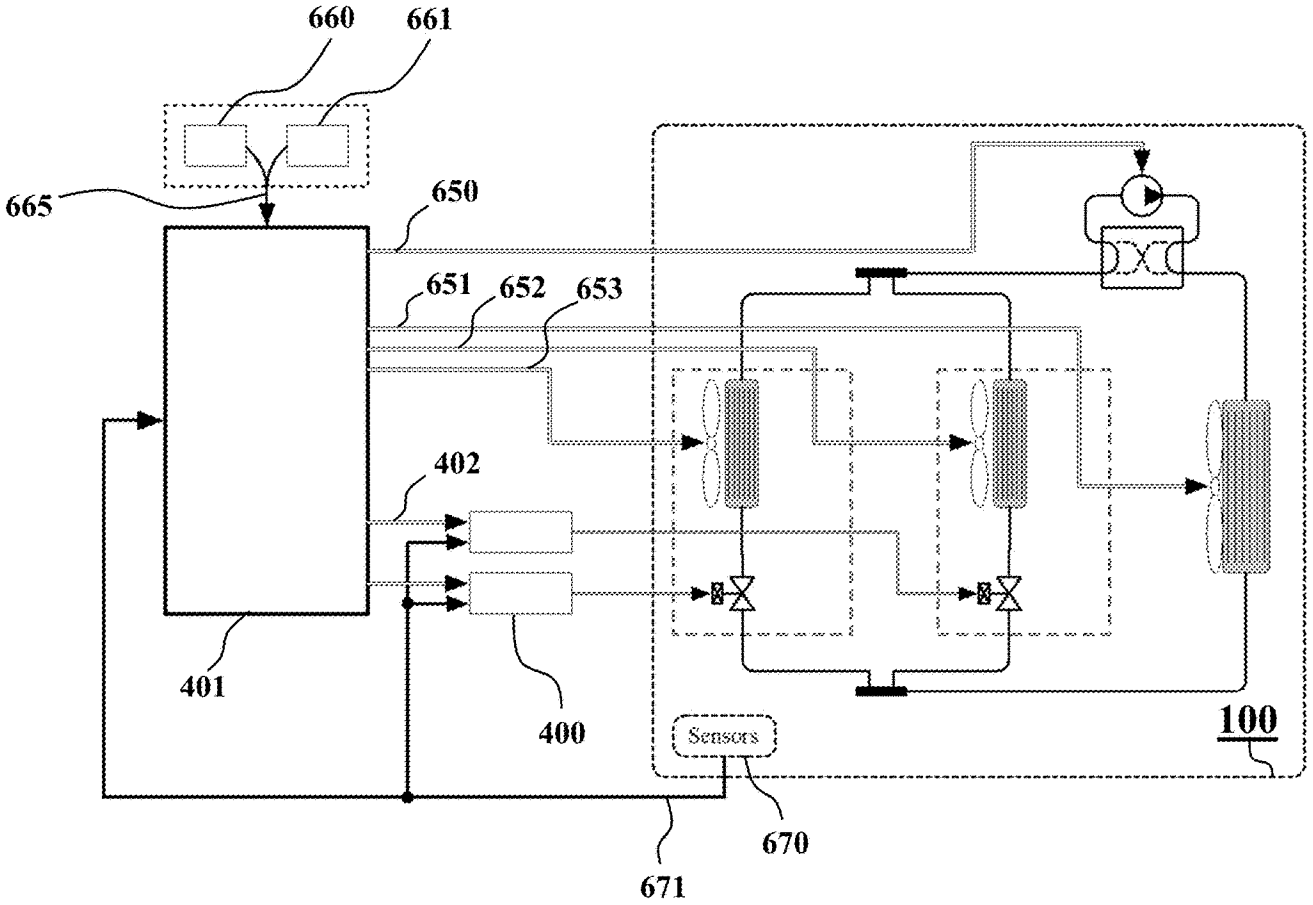
FIG. 6 is an illustration of the interfaces of the control method to the actuators and sensors of a multi-zone vapor compression system.

FIG. 6 shows a schematic of a vapor compression system 100 controlled according to some embodiments of the invention. The supervisory controller 401 includes a predictive controller, such as a controller implementing a model predictive control (MPC), which can provide commands directly to some actuators of the MZ-VCS (e.g., a compressor speed command 650, or an outdoor fan speed command 651), and/or provide setpoints 402 to the capacity controllers 400 previously described. A supervisory controller 401 receives information from sensors 670 configured to measure various temperatures, pressures, flow rates or other information about the operation of the system, including measurable disturbances such as the ambient air temperature.

The controller can be provided with setpoints 665 that can be classified according to source. One type of setpoint may refer to desired zone temperature 660 and can come from a thermostat, wireless remote control, or internal memory or storage media. Another type of setpoint 661 may refer to desired energy consumption performance or other internal machine parameters and can come from a building owner or utility as a signal in the demand response framework. Together, these two types of setpoints are provided to the supervisory controller 401. Note that the setpoints provided to the supervisory controller are external signals and distinct from the (internally-generated) setpoints provided to the capacity controllers that are conceptually actuator commands.

The supervisory controller then computes commands such that some measured outputs are driven to their setpoints. These control inputs can include an indoor unit fan speed 653, 652, an outdoor unit fan speed 651, a compressor rotational speed 650, a flow reversing valve position, and/or setpoints to capacity controllers 402. In this manner, the controller controls operation of the multi-zone vapor compression system such that the setpoint values are achieved in the presence of disturbances, such as thermal loads, acting on the system.

Figure 7:
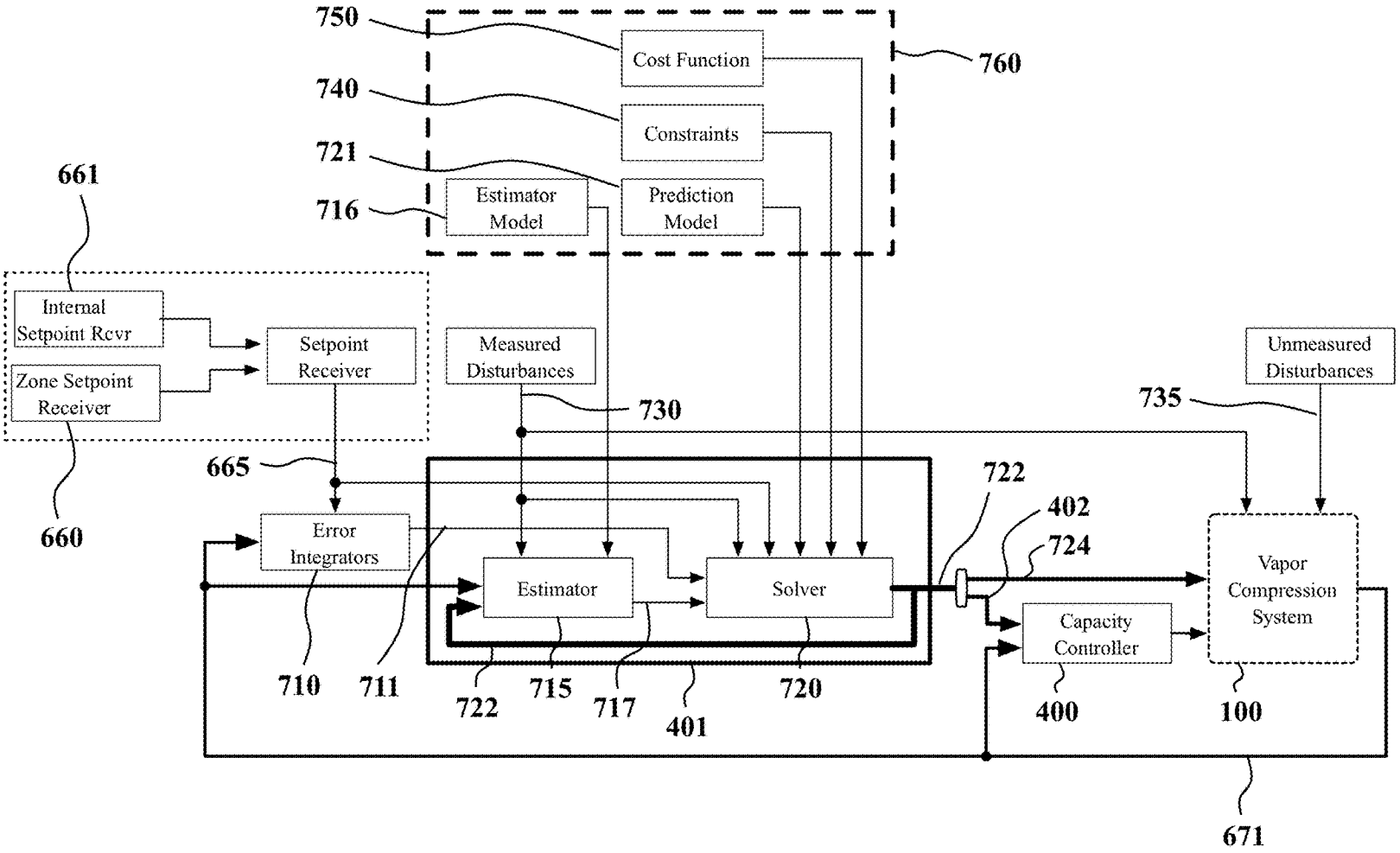
FIG. 7 is a block diagram of a controller including a predictive supervisory controller and a capacity controller according to some embodiments of the invention.

FIG. 7 shows an operative diagram of the control system including a predictive controller 401, one or more capacity controllers 400, one or more error integrators 710, external setpoints 665 and various associated controller parameters designed offline 760. The predictive controller includes an estimator module 715 and a solver module 720. The estimator receives sensor information 671, measured disturbances 730 acting on the vapor compression system, and the current control inputs 722 to the MZ-VCS, and uses an estimator model 716 to generate an estimate of the state 717 of the MZ-VCS. The estimator is designed such that the difference between the predicted output according to the estimator model and the measured output is driven to zero in the presence of constant unmeasured disturbances 735 acting on the system.

The values of the measured outputs of the operation of the MZ-VCS can be determined in response to receiving at least one value of a setpoint, e.g., a desired temperature in a zone. In some embodiments, the measured outputs include at least one performance output controlled according to the value of a setpoint and at least one constrained output controlled to satisfy constraints independent from the value of the setpoint.

For example, the performance outputs can include one or combination of a temperature of an air in a controlled space, a discharge temperature of a compressor, and a suction temperature of the compressor. The constrained outputs can include one or combination of a discharge temperature of a compressor, suction temperature of the compressor, a discharge superheat temperature of the compressor, a temperature of an evaporator heat exchanger, and a temperature of the condenser heat exchanger.

The estimator 715 takes advantage of the iterative nature of the predictive control method and updates the state estimate of the system iteratively and/or concurrently with the determination of the control signal. For example, a current value of the state can be determined based on the previous value of the state and an error between the output of the VCS predicted based on the previous value of the state and the estimator model, and the measured output of the system. For example, the state estimate can be determined iteratively at each estimation time interval, and the control inputs can be determined at each control time interval. In one embodiment the estimation time interval is less than or equal to the control time interval. In this way, the estimated state converges to the true state regardless of noise in the measurements and disturbances acting on the vapor compression system.

For example, in one embodiment, the supervisory controller determines the set of control inputs achieving a plurality of setpoints including zone temperature setpoints and a performance setpoint specifying a trade-off between an amount of heat per unit of consumed energy and the thermal capacities of the heat exchangers. The supervisory controller determines the set of control inputs by optimizing a cost function that penalizes for deviation from each setpoint.

The solver 720 determines the control inputs 722 for the MZ-VCS 100 by solving a constrained optimization problem defined by a prediction model 721, the input and/or output constraints 740 on the operation of the system, a cost function 750 that penalizes the relative importance of control moves and performance outputs, the measured disturbances 730, setpoints for the performance outputs 665, the estimated system state 717, and error integrator values 711. The constraints 740 represent physical and operational limitations of the system.

The control inputs 722 may be separated into commands 724 that act on the vapor compression system directly, and commands which represent thermal capacity setpoints 402 provided to the capacity controllers. The capacity controllers in turn modulate the expansion valves such that the indoor heat exchanger thermal capacities are driven to their setpoint capacities. The prediction model 721 used by the solver includes a model of the joint system of the dynamics of the capacity controller and the vapor compression system, which is linear and predictable by design of the capacity controller as previously described.

The prediction model 721 is defined so that the resulting cost function has a minimum at zero, and the design of the terminal cost and terminal control law guarantee locally asymptotically stable behavior of the tracking error between the performance outputs and their corresponding setpoints.

For example, one embodiment of the invention uses the following continuous time linear time-invariant model of a multi-zone vapor compression system:

$$\dot{x}(t) = Ax(t) + [\,B \quad B_d\,]\begin{bmatrix} u(t) \\ d(t) \end{bmatrix}, \qquad (1)$$

$$y_m(t) = Cx(t)$$

where x are the dynamic states, $y_m$ are the measured outputs, u are the controlled inputs, d are the measured disturbances, and A, B, Bd, and C are parameters of the model of the system.

Offset-Free Estimation of States

Some embodiments of the invention are based on recognition that by designing an estimator which drives the error between the predicted outputs and measured outputs to zero when unmeasured disturbances 735, e.g. the thermal load, are constant, a model predictive controller that uses the output of this estimator can achieve error-free regulation of the performance outputs and also guarantee enforcement of output constraints. In various embodiments, the estimator 715 uses auxiliary states to describe the effect of unmeasured disturbances and model uncertainty on the system.

Figure 8A:
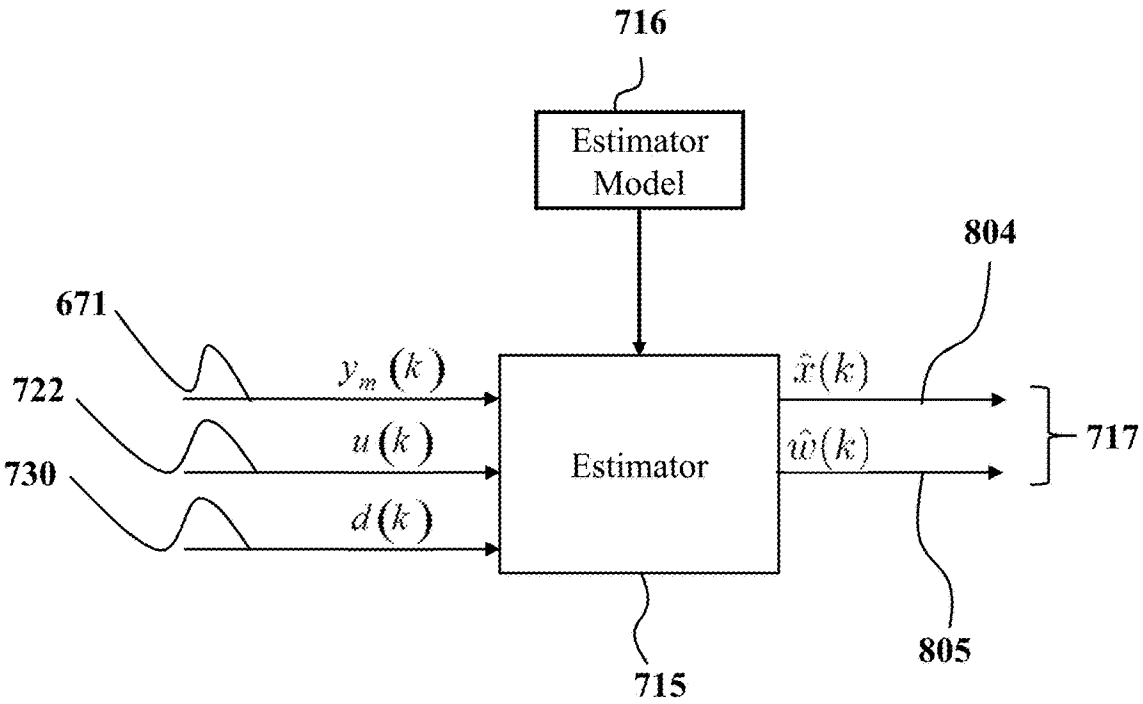
FIG. 8A is a schematic of input and output signals of the estimator of the controller according to some embodiments of the invention.

FIG. 8A shows a diagram of the estimator 715, which takes as inputs the measured outputs 671, the control inputs 722 to the system, an estimator model 716, and the measured disturbances 730 and produces an estimate of the states 717 of the VCS include a main state 804 representing the operation of the VCS and an auxiliary state 805 representing the effect of unknown disturbances on each measured output of the VCS.

Some embodiments provide the estimator 715 by determining an estimator relationship between the control inputs, the measured disturbances, the measured outputs, and the main dynamic states of the VCS. The estimator relationship can be determined empirically according to experimental data or analytically according to principles of physics. Next, some embodiments augment the estimator relationship with p auxiliary states to produce the estimator model, wherein p is a number of the measured outputs, and wherein the auxiliary states represent an aggregate effect of the unknown disturbances and uncertainties on the measured outputs at a steady operating condition of the VCS.

For example, one embodiment discretizes the VCS model (1) with a sample time of $Ts_e$, resulting in (2).

$$x(k+1)=A_e x(k)+B_e u(k)+B_{d,e} d(k)$$

$$y_m(k)=C_e x(k) \tag{2}$$

The estimator model (2) is augmented with auxiliary $w \in \square^{p\times 1}$ is the number of measured outputs in the system. For example, this augmented estimator model can take the form:

$$\begin{bmatrix} x(k+1) \\ w(k+1) \end{bmatrix} = \begin{bmatrix} A_e & 0 \\ 0 & I \end{bmatrix} \begin{bmatrix} x(k) \\ w(k) \end{bmatrix} + \begin{bmatrix} B_e \\ 0 \end{bmatrix} u(k) + \begin{bmatrix} B_{d,e} \\ 0 \end{bmatrix} d(k), \tag{3}$$

$$y_m(k) = [\, C_e \quad I \,] \begin{bmatrix} x(k) \\ w(k) \end{bmatrix},$$

where the auxiliary states are constants added to each measured output.

The dynamics of the estimator are given by $$\begin{bmatrix} \hat{x}(k+1) \\ \hat{w}(k+1) \end{bmatrix} = \begin{bmatrix} A_e & 0 \\ 0 & I \end{bmatrix} \begin{bmatrix} \hat{x}(k) \\ \hat{w}(k) \end{bmatrix} + \begin{bmatrix} B_e \\ 0 \end{bmatrix} u(k) + \begin{bmatrix} B_{d,e} \\ 0 \end{bmatrix} d(k) + \begin{bmatrix} L_{e1} \\ L_{e2} \end{bmatrix} (y_m(k) - \hat{y}_m(k)) \tag{4}$$

$$\hat{y}_m(k) = [\, C_e \quad I \,] \begin{bmatrix} \hat{x}(k) \\ \hat{w}(k) \end{bmatrix}$$

where $$L_e = \begin{bmatrix} L_{e1} \\ L_{e2} \end{bmatrix}$$

is the estimator gain.

Some embodiments determine the estimator gain L using the estimator model so that the time-based performance of the closed-loop estimator is guaranteed to be stable. The estimator gain can be designed in a variety of ways, e.g., using Kalman filter or Luenberger observer design techniques.

Figure 8B:
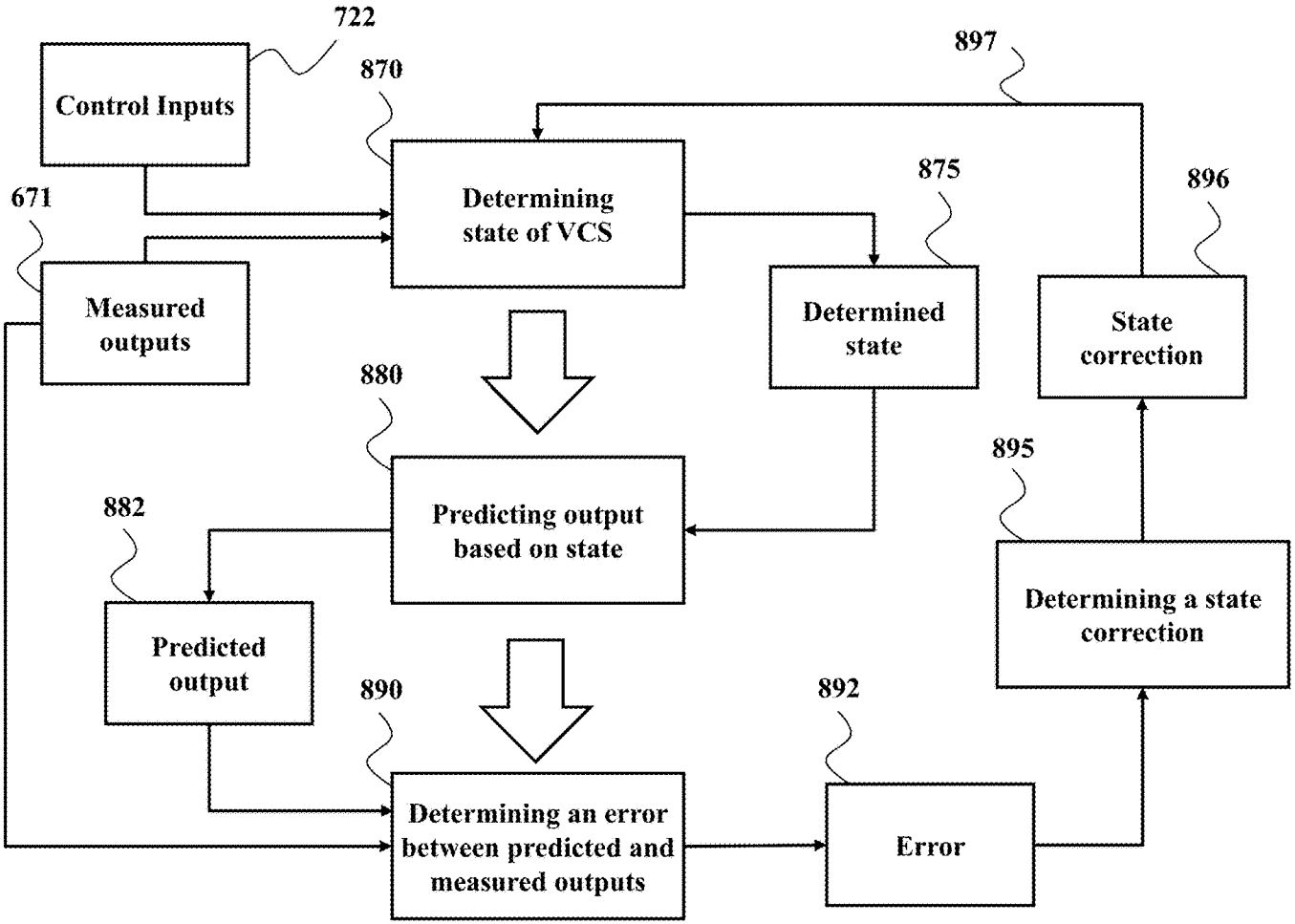
FIG. 8B is a block diagram of a method performed by the estimator for determining the state of the vapor compression system according to some embodiment of the invention.

FIG. 8B shows a block diagram of a method for determining the states by the estimator 715 for a current time step of the control according to one embodiment of the invention. The method determines 870 the states 875 of the VCS based on the control inputs 722 and the measured outputs 671 determined for a previous time step of the control, and predicts 880 outputs 882 of the VCS using the state 875 and the estimator model 716. The method determines 890 an error 892 between the predicted 882 and the measured 671 outputs of the VCS, and determines 895 a state correction 896 according to the error.

The state correction is mathematically described by the term $$\begin{bmatrix} L_{e1} \\ L_{e2} \end{bmatrix} (y_m(k) - \hat{y}_m(k))$$

in (4). The error 892 is scaled by the estimator gain $L_e$ to determine 895 the state correction 896. This quantity is then added to the predicted state based on the estimator model shown in Equation (3). The method updates 897 the states of the VCS with the state correction. This step of the method 896 can be performed once or repeated several times within the current time step of the control.

Figure 8C:
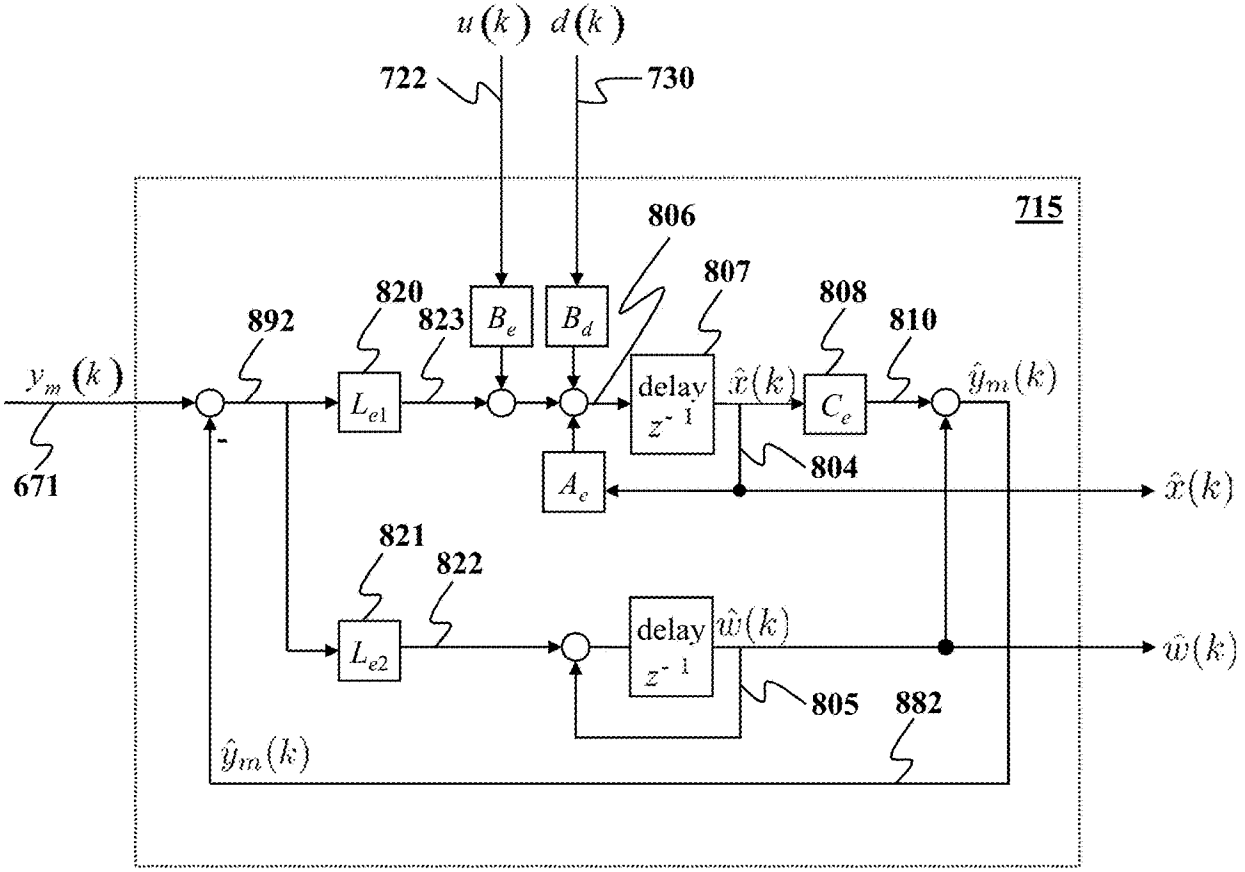
FIG. 8C is a block diagram of the estimator according to some embodiment of the invention.

FIG. 8C shows a diagram of the estimator 715 according to one embodiment of the invention. Discrete-time measurements of the control input 722, the measured disturbance 730, and the current physical state estimate 804, are obtained and used to evaluate Equation (3) to estimate of the physical state at the next time step 806. This estimate is corrected 823 with the error 892 between the measured output 671 and the estimated output 882 weighted by the estimator gain $L_{e1}$ 820. The state estimate for the next time step 806 is then delayed by one time step 807, resulting in the physical state estimate at the current time step 804. The physical state estimate 804 is scaled by the output matrix $C_e$ 808 resulting in the predicted output 810.

In one embodiment, the error 892 is multiplied by the estimator gain $L_{e2}$ 821 to determine the state correction 822 for the auxiliary state estimate 805. The estimated auxiliary state 805 is added to the predicted output 810, and their sum, the estimated output, 882, is compared against the measured output 671. The physical 804 and auxiliary 805 state estimates reach a constant value once the difference between the estimated output 882 and the measured output 671 is zero.

Model Predictive Control Problem

Referring again to FIG. 7, the control inputs 722 are computed as the solution to a constrained optimization problem by the solver 720. At some predetermined sample period $T_{pr}$, the solver receives an estimate of the VCS state 717 from the estimator and the error integrator values 711 from the error integrators 710, and uses a prediction model 721 of the VCS to predict the response of the system to potential control actions starting from the current state. The solver then computes the set of control actions that are predicted to minimize a cost function 750 that is designed to penalize the relative use of actuators to achieve the desired performance such as driving performance outputs to their associated setpoints. Furthermore, the optimization problem solved by the solver 720 may include constraints 740 that represent limits on inputs and outputs. The optimization problem considers a finite horizon of future responses over which to optimize.

The constraints can represent physical limitations of the performance of the system and safety limitations on the operation of the system. For example, at time t the current state of the machine is estimated and an admissible cost-minimizing control strategy is determined for some future time horizon. Specifically, an online calculation determines a cost-minimizing control strategy until time t+T, where T represents the length of the finite horizon. Typically, only the first step of the control strategy is implemented, then the state is estimated again and the calculations are repeated starting from the newly-estimated state, yielding a new set of control inputs.

Figure 9:
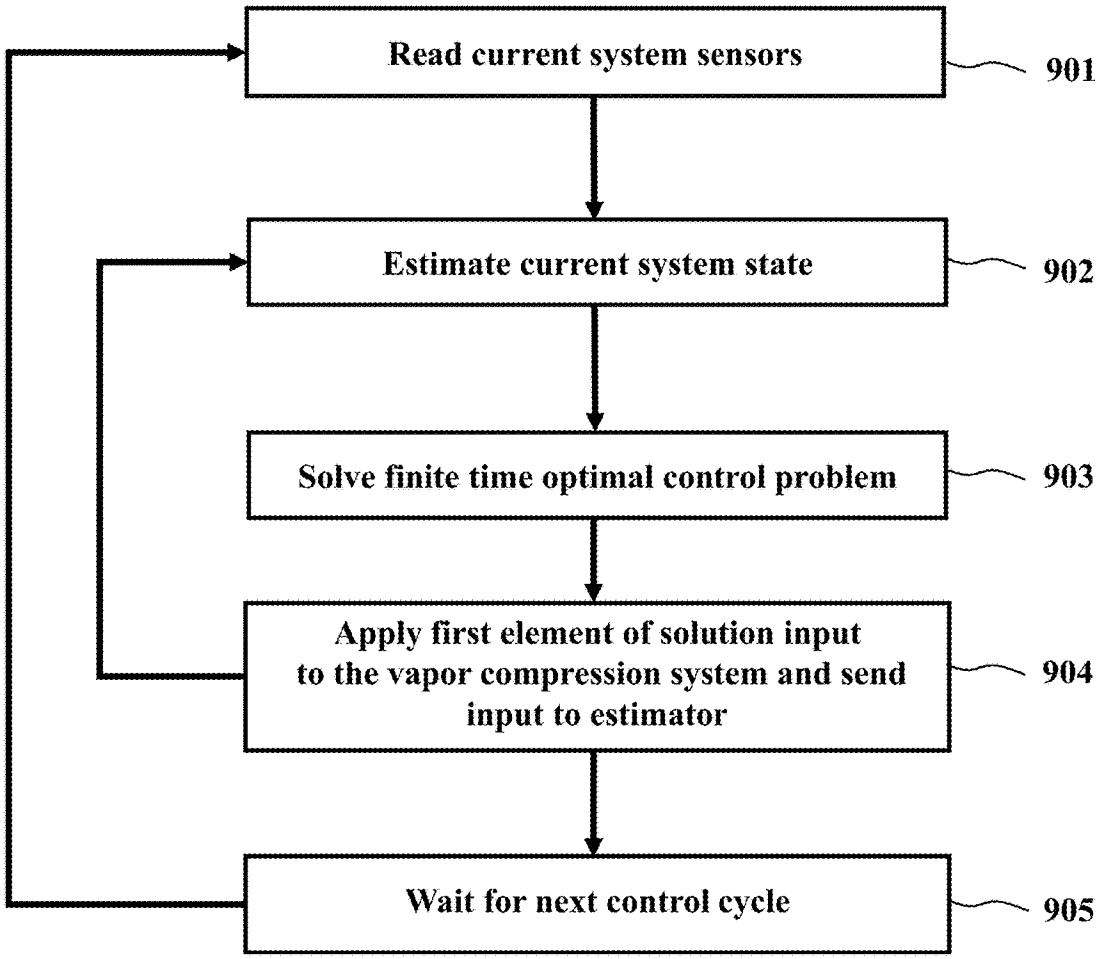
FIG. 9 is a flow chart of a method for model predictive control according to one embodiment of the invention.

FIG. 9 shows a flow chart of a method for model predictive control of the VCS according to one embodiment of the invention. Some embodiments determine 901 the measured outputs, e.g., receives information from the sensors of the VCS and estimates 902 the state of the VCS using the estimator. Next, the solver 720 solves 903 the constrained finite time optimization problem and applies 904 the first step of that solution to the vapor compression system and/or capacity controllers. Some embodiments also send the control inputs to the estimator 715 and transition 905 to the next control cycle.

Some embodiments select the offline parameters 760 in such a way as to guarantee that system constraints on both the control inputs and measured outputs are satisfied. This formulation requires i) a particular construction of the prediction model and ii) the design of a terminal cost and control law so that the model predictive controller tracking error is locally asymptotically stable. Furthermore, the design of the terminal cost and control law should not require that the number of control inputs is equal to the number of performance inputs. In fact, in some embodiments, the number of control inputs greater than the number of performance inputs. The extra degrees of freedom that are available allow high performance, such as zero steady-state error setpoint tracking, to be maintained when system constraints are active.

Prediction Model

A prediction model for the VCS operation is a set of equations that describe how the measured outputs change over time as functions of current and previous inputs and capacity controller setpoints, and previous measured outputs. The state of the VCS is any set of information, in general time-varying, that, together with a model of the VCS and future inputs, can uniquely define the future motion of the machine.

Figure 10:
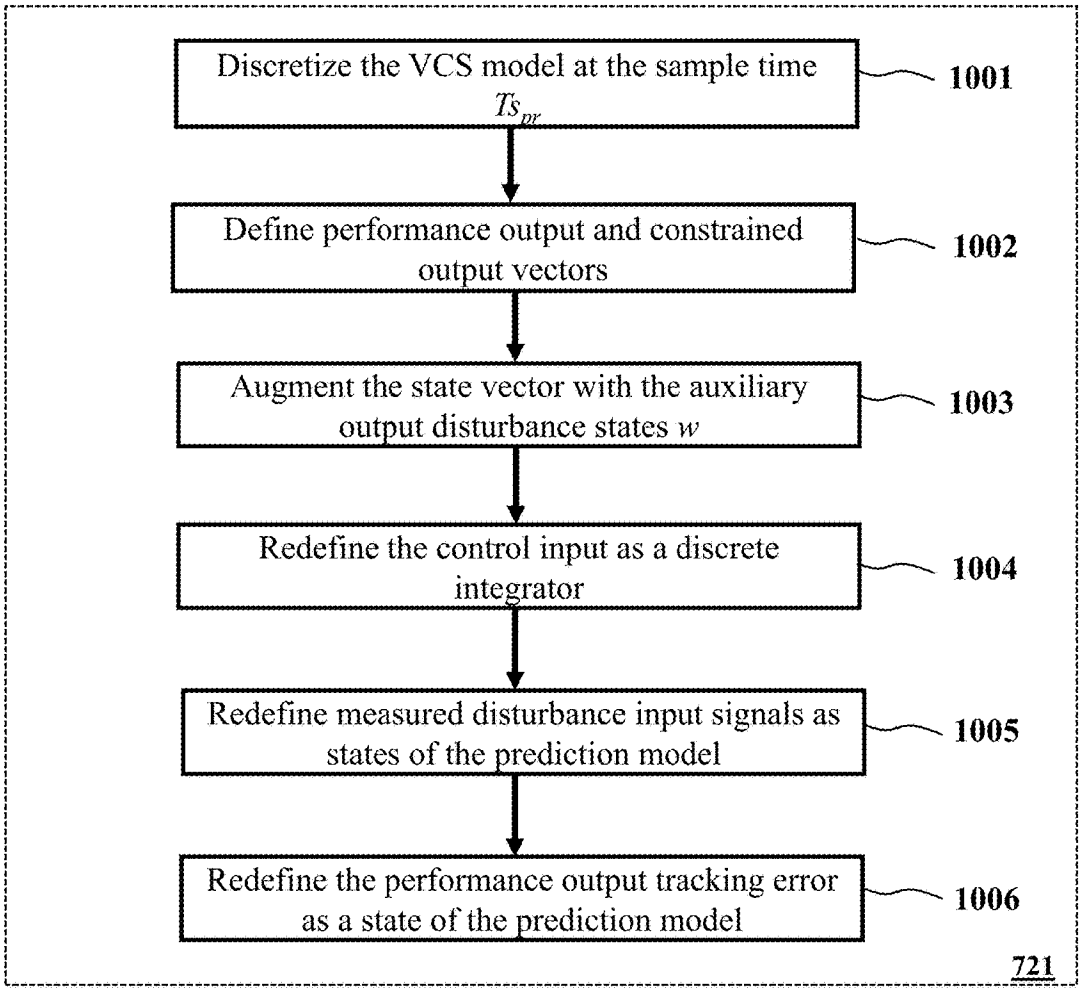
FIG. 10 is a flow chart of a method for creating a prediction model according to some embodiments of the invention.

FIG. 10 shows a block diagram of a method for creating the prediction model according to some embodiments of the invention. A discrete-time model of the system dynamics is used to predict the VCS response over the chosen prediction horizon, N. The basic state space representation of the prediction model, shown in Equation (5), is based on Equation (1) and discretized 1001 with a sample period of $Ts_{pr}$, $$x(k+1)=A_{pr}x(k)+B_{pr}u(k)+B_{d,pr}d(k)$$

$$y_c(k)=C_{pr}x(k)$$

$$y_p(k)=E_{pr}x(k) \tag{5}$$

where x(k) is the state of the system, k is the time index, and $A_{pr}$, $B_{pr}$, $B_{d,pr}$, $C_{pr}$ and $E_{pr}$ are matrices. Two (potentially overlapping) subsets of the measured outputs 671 are defined 1002 to include the constrained outputs $y_c$ and the performance outputs $y_p$. The constrained output matrix $C_{pr}$, contains those rows of C such that $y_c$ describes the outputs to be constrained in the optimization solver. Similarly, the performance output matrix $E_{pr}$ contains those rows of C such that $y_p$ describes the performance outputs that are explicitly characterized in the cost function.

Some embodiments modify the prediction model of Equation (5) so that the resulting optimization problem can be solved as a quadratic program. First, the prediction model is augmented 1003 with the same auxiliary (output disturbance) states w that were added to the estimator model so that the prediction model accurately predicts the effect of control decisions on the constrained and performance outputs, $$\begin{bmatrix} x(k+1) \\ w(k+1) \end{bmatrix} = \begin{bmatrix} A_{pr} & 0 \\ 0 & I \end{bmatrix} \begin{bmatrix} x(k) \\ w(k) \end{bmatrix} + \begin{bmatrix} B_{pr} \\ 0 \end{bmatrix} u(k) + \begin{bmatrix} B_{d,pr} \\ 0 \end{bmatrix} d(k) \tag{6}$$

$$y_c(k) = [\, C_{pr} \quad C_w \,] \begin{bmatrix} x(k) \\ w(k) \end{bmatrix}$$

$$y_p(k) = [\, E_{pr} \quad E_w \,] \begin{bmatrix} x(k) \\ w(k) \end{bmatrix}$$

where $C_w$ and $E_w$ are matrices of zeros and ones defined to be consistent with the definition of $y_c$, $y_p$, and w. The inclusion of w provides the information to the prediction model about effect of the unmeasured disturbances on the performance of the system.

Another augmentation involves expressing the input as a discrete integrator 1004 where inputs are expressed as changes from the previous value. Let u(k)=u(k−1)+du(k). This change of variables enables constraints to be placed on the rate of change of the control input. It also results in cost function whose minimum is zero. Let $x_u(k)=u(k-1)$ and $\bar{u}=du(t)$. Additionally, because constraints could be imposed on the value of the actual control input (for example maximum or minimum actuator limits), u(k−1), in addition to the change in the control input from one time step to another (for example, actuator rate limits), $\bar{u}(k)$, we augment the constrained output vector $y_c$, with $y_u=x_u$ as shown in (7).

$$\begin{bmatrix} x(k+1) \\ w(k+1) \\ x_u(k+1) \end{bmatrix} = \begin{bmatrix} A_{pr} & 0 & B_{pr} \\ 0 & I & 0 \\ 0 & 0 & I \end{bmatrix} \begin{bmatrix} x(k) \\ w(k) \\ x_u(k) \end{bmatrix} + \begin{bmatrix} B_{pr} \\ 0 \\ I \end{bmatrix} \bar{u}(k) + \begin{bmatrix} B_{d,pr} \\ 0 \\ 0 \end{bmatrix} d(k) \tag{7}$$

$$\begin{bmatrix} y_c(k) \\ y_u(k) \end{bmatrix} = \begin{bmatrix} C_{pr} & C_w & 0 \\ 0 & 0 & I \end{bmatrix} \begin{bmatrix} x(k) \\ w(k) \\ x_u(k) \end{bmatrix}$$

$$y_p(k) = [\, E_{pr} \quad E_w \quad 0 \,] \begin{bmatrix} x(k) \\ w(k) \\ x_u(k) \end{bmatrix}$$

Next, the state vector is augmented 1005 with the measured disturbance signals 730. Let d(k+1)=d(k) which models the disturbance as a constant over the prediction horizon, and $x_d$ (k)=d(k). Then $$\begin{bmatrix} x(k+1) \\ w(k+1) \\ x_u(k+1) \\ x_d(k+1) \end{bmatrix} = \begin{bmatrix} A_{pr} & 0 & B_{pr} & B_{d,pr} \\ 0 & I & 0 & 0 \\ 0 & 0 & I & 0 \\ 0 & 0 & 0 & I \end{bmatrix} \begin{bmatrix} x(k) \\ w(k) \\ x_u(k) \\ x_d(k) \end{bmatrix} + \begin{bmatrix} B_{pr} \\ 0 \\ I \\ 0 \end{bmatrix} \bar{u}(k) + \begin{bmatrix} B_{d,pr} \\ 0 \\ 0 \\ 0 \end{bmatrix} d(k) \tag{8}$$

$$\begin{bmatrix} y_c(k) \\ y_u(k) \end{bmatrix} = \begin{bmatrix} C_{pr} & C_w & 0 & 0 \\ 0 & 0 & I & 0 \end{bmatrix} \begin{bmatrix} x(k) \\ w(k) \\ x_u(k) \\ x_d(k) \end{bmatrix}$$

$$y_p(k) = [\, E_{pr} \quad E_w \quad 0 \quad 0 \,] \begin{bmatrix} x(k) \\ w(k) \\ x_u(k) \\ x_d(k) \end{bmatrix}$$

In addition, the state space representation is also augmented 1006 with the setpoints that are regulated during the control.

$$\begin{bmatrix} x(k+1) \\ w(k+1) \\ x_u(k+1) \\ x_d(k+1) \\ x_r(k+1) \end{bmatrix} = \begin{bmatrix} A_{pr} & 0 & B_{pr} & B_{d,pr} & 0 \\ 0 & I & 0 & 0 & 0 \\ 0 & 0 & I & 0 & 0 \\ 0 & 0 & 0 & I & 0 \\ 0 & 0 & 0 & 0 & I \end{bmatrix} \begin{bmatrix} x(k) \\ w(k) \\ x_u(k) \\ x_d(k) \\ x_r(k) \end{bmatrix} + \begin{bmatrix} B_{pr} \\ 0 \\ I \\ 0 \\ 0 \end{bmatrix} \bar{u}(k) + \begin{bmatrix} B_{d,pr} \\ 0 \\ 0 \\ 0 \\ 0 \end{bmatrix} d(k), \tag{9}$$

$$\begin{bmatrix} y_c(k) \\ y_u(k) \end{bmatrix} = \begin{bmatrix} C_{pr} & C_w & 0 & 0 & 0 \\ 0 & 0 & I & 0 & 0 \end{bmatrix} \begin{bmatrix} x(k) \\ w(k) \\ x_u(k) \\ x_d(k) \\ x_r(k) \end{bmatrix},$$

$$z(k) = [\, E_{pr} \quad E_w \quad 0 \quad 0 \quad -I \,] \begin{bmatrix} x(k) \\ w(k) \\ x_u(k) \\ x_d(k) \\ x_r(k) \end{bmatrix},$$

where $z(k)=y_p(k)-r(k)$ and $x_r(k)=r(k)$.

In some embodiments, the prediction model can be rewritten in the following form:

$$\begin{bmatrix} \xi(k+1) \\ r(k+1) \end{bmatrix} = \begin{bmatrix} A_\xi & 0 \\ 0 & A_r \end{bmatrix} \begin{bmatrix} \xi(k) \\ r(k) \end{bmatrix} + \begin{bmatrix} B_\xi \\ 0 \end{bmatrix} \bar{u}(k), \tag{10}$$

$$\bar{y}(k) = [\, C_\xi \quad 0 \,] \begin{bmatrix} \xi(k) \\ r(k) \end{bmatrix},$$

$$z(k) = [\, E_\xi \quad -E_r \,] \begin{bmatrix} \xi(k) \\ r(k) \end{bmatrix},$$

where $\xi(k)=[x(k)' \; w(k)' \; x_u(k)' \; x_d(k)']'$, $r(k)=x_r(k)$, and $\bar{z}(k)=z(k)$.

Determining the Terminal Cost and Control Law

Figure 11:
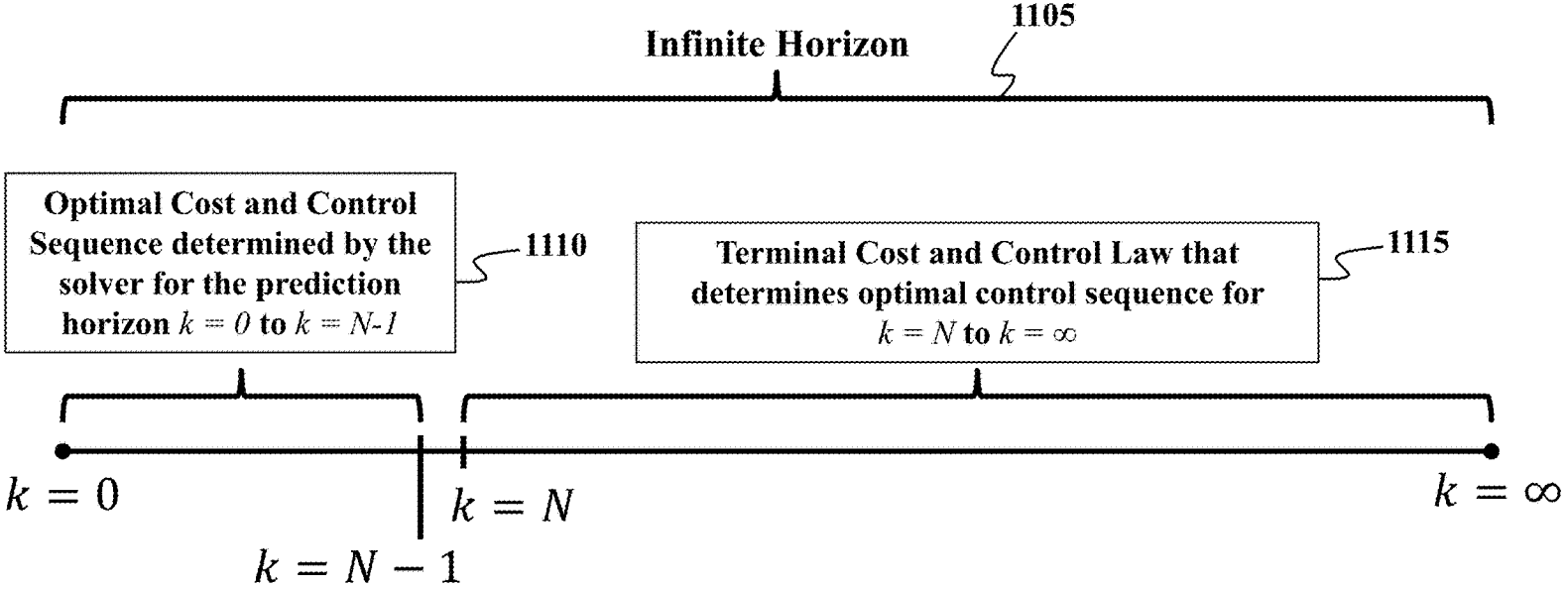
FIG. 11 is a schematic of the relationship between a terminal cost and control law and the optimal cost and control sequence determined by the controller according to some embodiment of the invention.

FIG. 11 is a schematic of the relationship between a terminal cost and control law and the optimal cost and control sequence determined by the controller according to some embodiment of the invention. Some embodiments design the terminal cost and terminal control law such that the physical state of the VCS converges asymptotically to a stable equilibrium condition where the VCS performance output have the same values as the corresponding setpoints.

The control method determines the optimal control input sequence and associated cost over a prediction horizon of length N steps. However, some embodiments guarantee that the system is locally asymptotically stable over an infinite horizon 1105, that is from time step k=0 until k=∞. Because the solver only determines the optimal control input sequence between k=0 and k=N−1 1110, a terminal cost and control law are used to describe and to influence how the system dynamics evolve from k=N to k=∞1115.

The complete finite horizon constrained optimal control problem can be given by $$\min_{U(t)} \left\| \begin{bmatrix} \xi(N) \\ r(N) \end{bmatrix} \right\|_P^2 + \sum_{k=0}^{N-1} \|\bar{z}(k \mid t)\|_{Q_z}^2 + \|\bar{u}(k \mid t)\|_R^2 \tag{11}$$

$$\begin{aligned} \text{s.t. } & \xi(k+1 \mid t) = A_\xi \xi(k \mid t) + B_\xi \bar{u}(k \mid t) \\ & r(k+1 \mid t) = A_r r(k \mid t) \\ & \bar{y}(k \mid t) = C_\xi \xi(k \mid t) \\ & \bar{z}(k \mid t) = E_\xi \xi(k \mid t) - E_r r(k \mid t) \\ & \bar{y}_{min} \le \bar{y}(k \mid t) \le \bar{y}_{max},\ k = 0, \ldots, N_c \\ & \bar{u}_{min} \le \bar{u}(k \mid t) \le \bar{u}_{max},\ k = 1, \ldots, N_u \\ & \bar{u}(k \mid t) = K \begin{bmatrix} \xi(k \mid t) \\ r(k \mid t) \end{bmatrix},\ k = N_u, \ldots, N-1 \\ & \xi(0 \mid t) = \xi(t) \\ & r(0 \mid t) = r(t) \end{aligned}$$

where P is the terminal cost weight and K is the terminal gain. In order to determine P and K, some embodiments construct the system $$\begin{aligned} & \bar{x}(k+1) = \bar{A}_{pr} \bar{x}(k) + \bar{B}_{pr} \bar{u}(k), \\ & \bar{z}(k) = \bar{E}_{pr} \bar{x}(k). \end{aligned} \tag{12}$$

where $$\xi(k)[x(k)' \; w(k)' \; x_u(k)' \; x_d(k)'],\ r(k) = x_r(k),\ \bar{x} = \begin{bmatrix} \xi \\ r \end{bmatrix},$$

$$\bar{A}_{pr} = \begin{bmatrix} A_\xi & 0 \\ 0 & A_r \end{bmatrix},\ \bar{B}_{pr} = \begin{bmatrix} B_\xi \\ 0 \end{bmatrix},\ \text{and } E_{pr} = [E_\xi \quad -E_r].$$

The system of (12) is not fully observable and not fully controllable because the controller cannot, in general, modify the reference or the disturbance, and the optimal cost does not depend on the absolute reference and output values but only on their difference. Accordingly, some embodiments apply an observability decomposition via an appropriate change of coordinates T, $$x_{obs} = Tx, X_{obs} = [x_o^T x_{no}^T]_T \tag{13}$$

and $$x_{obs}(k+1) = \begin{bmatrix} A_o & 0 \\ A_{no,o} & A_{no} \end{bmatrix} \begin{bmatrix} x_o(k) \\ x_{no}(k) \end{bmatrix} + \begin{bmatrix} B_o \\ B_{no} \end{bmatrix} u(k), \tag{14}$$

$$z(k) = [\, E_o \quad 0 \,] \begin{bmatrix} x_o(k) \\ x_{no}(k) \end{bmatrix},$$

where $x_{no}$ are the coordinates of the state vector with respect to a basis of the unobservable subspace, $x_o$ are the coordinates of the state vector with respect to a basis of the observable subspace, and the pair $(A_o, E_o)$ is observable. The subscript o is used to refer to the observable subspace. Then, the terminal gain $K=[K_o \; 0]T$ and terminal cost weight $$P = T' \begin{bmatrix} P_o & 0 \\ 0 & 0 \end{bmatrix} T$$

where $$K_o=-(B_o^TP_oB_o+R)^{-1}B_o^TP_oA_o \tag{15}$$

and $P_o$ is the solution of the Riccati equation $$P_o=E_o^TQ_oE_o+A_o^TP_oA_o-A_o^TP_oB_o(B_o^TP_oB_o+R)^{-1}B_o^TP_oA_o \tag{16}$$

The transformation matrix T is used to transform $K_o$ and $P_o$ to the coordinates of the original state vector (12). Moreover, the solution $P_o$ is guaranteed to exist, which ensures that for the controller that solves (11), $\lim_t\|z(t)\|=0$, and the tracking error z(t) is stable. Furthermore, if $A_\xi$, $A_r$ (10) do not share unstable eigenvalues, i.e., eigenvalues with value larger than 1, such that the eigenvectors images through $E_\xi$, and $E_r$ (10) share a subspace, there exists $\xi_{eq}\in^{dimA_\xi}$ with $\|\xi_{eq}\|<\infty$ such that $\lim_t\|\xi(t)-\xi_{eq}\|=0$. This is the case for the VCS controller in some embodiments of this application, due to the only common eigenvalues between $A_\xi$ and $A_r$ are marginally stable, i.e., they have value 1, due to the construction of (6), (7), and (8). Thus, there are no shared unstable eigenvalues, and hence the VCS converges asymptotically to a stable equilibrium condition where the VCS performance output have the same values as the corresponding setpoints.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

The invention claimed is:

1. A multi-zone vapor compression system (MZ-VCS), comprising:

a compressor connected to a set of heat exchangers controlling the environments in a set of zones, wherein there is at least one heat exchanger for each zone;

a supervisory controller including a processor determining a set of control inputs for controlling a vapor compression cycle of the MZ-VCS, wherein the supervisory controller is a model predictive controller determining the set of control inputs using a model of the MZ-VCS including a linear relationship between the thermal capacity of each heat exchanger and the temperature in a corresponding zone controlled by the heat exchanger; and a set of capacity controllers, wherein there is one capacity controller for each heat exchanger, each capacity controller enforces the linear relationship between the thermal capacity and the temperature in the corresponding zone.

2. The MZ-VCS of claim 1, wherein the supervisory controller optimizes a cost function subject to constraints on the vapor compression cycle to produce the set of control inputs including a value of the thermal capacity requested for each heat exchanger to achieve a setpoint temperature in the corresponding zone, wherein the capacity controller determines a setpoint temperature of a refrigerant passing through the heat exchanger using a value of the requested thermal capacity and a setpoint function mapping values of the requested thermal capacity to values of the temperature of refrigerant and iteratively enforces the linear relationship by adjusting a position of a valve controlling the refrigerant passing through the heat exchanger to reduce an error between the setpoint temperature of the refrigerant and a measured temperature of the refrigerant.

3. The MZ-VCS of claim 2, wherein the heat exchanger includes an inlet header pipe connected to a set of paths for passing the refrigerant, wherein the inlet header pipe splits the refrigerant into the set of paths, wherein the capacity controller selects the path from the set of paths for controlling the position of the valve based on the requested thermal capacity and uses the measured temperature of the refrigerant in the selected path to adjust the position of the valve.

4. The MZ-VCS of claim 3, wherein the capacity controller selects a sensor from a set of sensors for measuring the temperature of the refrigerant in the set of paths of the corresponding heat exchanger and adjusts the position of the valve based on the measured temperature measured by the selected sensor.

5. The MZ-VCS of claim 4, wherein the setpoint function is a continuous function that switches at a point of saturation of each sensor in the set of sensors.

6. The MZ-VCS of claim 4, wherein the capacity controller includes a feedback controller, wherein a gain of the feedback controller is selected based on the selected sensor, such that different sensors in the set are associated with different gains.

7. The MZ-VCS of claim 4, wherein the capacity controller selects a sensor from the set of sensors for measuring the temperature of the refrigerant in the set of paths of the corresponding heat exchanger based on the requested thermal capacity and the setpoint function and adjusts the position of the valve based on the measured temperature measured by the selected sensor, wherein the setpoint function is a continuous function that switches at a point of saturation of each sensor in the set of sensors.

8. The MZ-VCS of claim 7, wherein the capacity controller includes a feedback controller, wherein a gain of the feedback controller is selected based on the selected sensor, such that different sensors in the set are associated with different gains.

9. The MZ-VCS of claim 1, wherein the supervisory controller optimizes a cost function subject to constraints on the vapor compression cycle to determine the set of control inputs achieving a plurality of setpoints including zone temperature setpoints and a performance setpoint specifying a trade-off between an amount of heat per unit of consumed energy and the thermal capacities of the heat exchangers, wherein the cost function penalizes for deviation from each setpoint.

10. The MZ-VCS of claim 1, wherein the supervisory controller is configured to execute an estimator module and a solver module, wherein the estimator module determines iteratively states of the MZ-VCS, such that a difference between outputs of the operation of the MZ-VCS estimated using the states and measured outputs of the operation of the MZ-VCS asymptotically approaches zero, and wherein the solver module determines the set of control inputs using the states of the MZ-VCS.

11. The MZ-VCS of claim 10, wherein the supervisory controller is configured to determine, in response to receiving at least one value of a setpoint, values of the measured outputs of the operation of the MZ-VCS, the measured outputs including at least one performance output controlled according to the value of the setpoint and at least one constrained output controlled to satisfy constraints independent from the value of the setpoint.

12. The MZ-VCS of claim 11, wherein the estimator module determines the states of the MZ-VCS using an estimator model of the MZ-VCS defining a relationship between the states of the MZ-VCS, control inputs and controlled outputs, such that a difference between outputs predicted using the estimator model and the measured outputs asymptotically approaches zero, wherein the states of the MZ-VCS include a main state representing the operation of the MZ-VCS and an auxiliary state representing the effect of unknown disturbances on each measured output of the MZ-VCS, and wherein the solver module determines the control inputs for controlling the operation of the MZ-VCS using a prediction model defining a relationship between the states of the MZ-VCS, the control inputs, the performance and constrained outputs, and the value of the setpoint, such that the constrained output satisfies the constraints, and a difference between the performance output and the value of the setpoint asymptotically approaches zero.

13. The MZ-VCS of claim 1, wherein the supervisory controller optimizes a cost function achieving a plurality of setpoints including zone temperature setpoints and a performance setpoint specifying a trade-off between an amount of heat per unit of consumed energy and the thermal capacities of the heat exchangers, wherein the cost function penalizes for deviation from each setpoint.

14. A multi-zone vapor compression system (MZ-VCS), comprising:

a set of heat exchangers configured for controlling environments in a set of zones, wherein there is at least one heat exchanger for each zone, wherein the heat exchanger includes an inlet header pipe connected to a set of paths for passing the refrigerant, and wherein the inlet header pipe splits the refrigerant into the set of paths;

a supervisory controller including a processor configured for optimizing a cost function subject to constraints on an operation of the MZ-VCS to produce a set of values of the thermal capacity requested for the set of heat exchangers to achieve setpoint temperatures in the corresponding zones, wherein the supervisory controller is a model predictive controller for determining the set of control inputs using a model of the MZ-VSC including a linear relationship between the thermal capacity of each heat exchanger and the temperature in a corresponding zone controlled by the heat exchanger; and a set of capacity controllers, there is one capacity controller for each heat exchanger, wherein each capacity controller is configured for controlling the corresponding heat exchanger to achieve the requested thermal capacity.

15. The MZ-VCS of claim 14, wherein the capacity controller determines a setpoint temperature of a refrigerant passing through the heat exchanger using a value of the requested thermal capacity and a setpoint function mapping values of the requested thermal capacity to values of the temperature of refrigerant and iteratively enforces the linear relationship by adjusting a position of a valve controlling the refrigerant passing through the heat exchanger to reduce an error between the setpoint temperature of the refrigerant and a measured temperature of the refrigerant.

16. The MZ-VCS of claim 14, wherein the supervisory controller is configured to execute an estimator module and a solver module, wherein the estimator module determines iteratively states of the MZ-VCS, such that a difference between outputs of the operation of the MZ-VCS estimated using the states and measured outputs of the operation of the MZ-VCS asymptotically approaches zero, and wherein the solver module determines the set of control inputs using the states of the MZ-VCS.

17. The MZ-VCS of claim 16, wherein the supervisory controller is configured to determine, in response to receiving at least one value of a setpoint, values of the measured outputs of the operation of the MZ-VCS, the measured outputs including at least one performance output controlled according to the value of the setpoint and at least one constrained output controlled to satisfy constraints independent from the value of the setpoint.

18. The MZ-VCS of claim 17, wherein the estimator module determines the states of the MZ-VCS using an estimator model of the MZ-VCS defining a relationship between the states of the MZ-VCS, control inputs and controlled outputs, such that a difference between outputs predicted using the estimator model and the measured outputs asymptotically approaches zero, wherein the states of the MZ-VCS include a main state representing the operation of the VCS and an auxiliary state representing the effect of unknown disturbances on each measured output of the MZ-VCS, and wherein the solver module determines the control inputs for controlling the operation of the MZ-VCS using a prediction model defining a relationship between the states of the MZ-VCS, the control inputs, the performance and constrained outputs, and the value of the setpoint, such that the constrained output satisfies the constraints, and a difference between the performance output and the value of the setpoint asymptotically approaches zero.

* * * * *